US010633821B2

(12) United States Patent
Sharpe et al.

(10) Patent No.: US 10,633,821 B2
(45) **Date of Patent: *Apr. 28, 2020**

(54) AUTOMATED BACKSLOPE CUTTING SYSTEM

(71) Applicant: GK Technology, Inc., Halstad, MN (US)

(72) Inventors: Kelly J. Sharpe, Halstad, MN (US); Darin G. Johnson, Halstad, MN (US); Travis C. Yeik, Bozeman, MT (US)

(73) Assignee: GK Technology, Inc., Halstad, MN (US)

( * ) Notice: Subject to any disclaimer, the term of this patent is extended or adjusted under 35 U.S.C. 154(b) by 238 days.

This patent is subject to a terminal disclaimer.

(21) Appl. No.: 15/888,334

(22) Filed: Feb. 5, 2018

(65) Prior Publication Data

US 2018/0155900 A1 Jun. 7, 2018

Related U.S. Application Data

(63) Continuation of application No. 15/201,083, filed on Jul. 1, 2016, now Pat. No. 9,885,169.

(51) Int. Cl.

| | |
|---|---|
| ***E02F 5/14*** | (2006.01) |
| ***E02F 3/76*** | (2006.01) |
| ***E02F 3/64*** | (2006.01) |
| ***E02F 5/02*** | (2006.01) |
| ***E02F 9/26*** | (2006.01) |

(52) U.S. Cl.

CPC ..... *E02F 5/145* (2013.01); *E02F 3/6454* (2013.01); *E02F 3/7681* (2013.01); *E02F 5/025* (2013.01); *E02F 9/262* (2013.01); *E02F 9/265* (2013.01)

(58) Field of Classification Search

CPC . E02F 9/261; E02F 9/262; E02F 5/025; E02F 5/145; E02F 3/6454; E02F 3/651

See application file for complete search history.

(56) References Cited

U.S. PATENT DOCUMENTS

| | | | | |
|---|---|---|---|---|
| 6,954,999 | B1 * | 10/2005 | Richardson | E02F 5/02 37/348 |
| 8,352,131 | B2 | 1/2013 | Yegerlehner | |
| 2003/0041485 | A1 * | 3/2003 | Whitten | E02F 3/08 37/352 |

(Continued)

*Primary Examiner* — Dale Moyer

(74) *Attorney, Agent, or Firm* — Neustel Law Offices

(57) ABSTRACT

An automated backslope cutting system which, based on a survey of an area, automatically adjusts a scraper blade during the cutting of a ditch backslope. The automated backslope cutting system generally includes a scraper which is automatically adjusted by a computing device to effectuate cutting of backslopes for a ditch based on a desired cut profile. The desired cut profile may be manually entered by the operator and automatically processed by the computing device. The area is surveyed with a positioning sensor to determine an optimal desired cut profile requiring a minimum number of cuts. A proximity sensor may be provided to accommodate for rotational movement of the cutting blade as the scraper performs cuts. A control software is provided for execution by the computing device to provide functionality including the automatic adjustment of hydraulic actuators controlling movement of the cutting blade as the scraper cuts the ditch and backslopes.

20 Claims, 26 Drawing Sheets

(56) References Cited

U.S. PATENT DOCUMENTS

| | | | | |
|---|---|---|---|---|
| 2003/0074812 | A1* | 4/2003 | Stump | E02F 5/06 37/348 |
| 2003/0147727 | A1* | 8/2003 | Fujishima | E02F 3/435 414/200 |
| 2006/0230645 | A1* | 10/2006 | McCain | E02F 3/437 37/348 |
| 2009/0112410 | A1* | 4/2009 | Shull | B25J 9/1664 701/50 |
| 2009/0187315 | A1* | 7/2009 | Yegerlehner | A01B 13/08 701/50 |
| 2009/0263195 | A1 | 10/2009 | Horan | |
| 2011/0286803 | A1 | 11/2011 | Baldinger | |
| 2012/0239258 | A1 | 9/2012 | Konno | |
| 2013/0255977 | A1 | 10/2013 | Braunstein | |
| 2015/0345114 | A1* | 12/2015 | Nomura | E02F 3/3677 37/379 |
| 2016/0076228 | A1* | 3/2016 | Nau | E02F 9/261 701/50 |
| 2017/0200306 | A1* | 7/2017 | Marsolek | G06T 17/05 |
| 2017/0292248 | A1 | 10/2017 | Matson | |

* cited by examiner

AUTOMATED BACKSLOPE CUTTING SYSTEM

CROSS REFERENCE TO RELATED APPLICATIONS

I hereby claim benefit under Title 35, United States Code, Section 120 of U.S. patent application Ser. No. 15/201,083 filed Jul. 1, 2016 which issues on Feb. 6, 2018 as U.S. Pat. No. 9,885,169. This application is a continuation of the Ser. No. 15/201,083 application. The Ser. No. 15/201,083 application is hereby incorporated by reference into this application.

STATEMENT REGARDING FEDERALLY SPONSORED RESEARCH OR DEVELOPMENT

Not applicable to this application.

BACKGROUND

Field

Example embodiments in general relate to an automated backslope cutting system which, based on a survey of an area, automatically adjusts a scraper blade during the cutting of a ditch.

Related Art

Any discussion of the related art throughout the specification should in no way be considered as an admission that such related art is widely known or forms part of common general knowledge in the field.

Ditching an area is important to allow for proper drainage of waterflow in the area. Generally, ditches are dug via cutting soil or other ground materials away to form a ditch slope which gradually loses elevation as it extends in the direction of water flow (high to low, wet area to outlet). While there are automated programs and systems which allow for cutting of a pre-set ditch, these programs and systems typically ignore creation of backslopes for the ditch and instead only provide instructions for scraping of the ditch bottom itself.

Each ditch generally includes a pair of backslopes which extend angularly upward from the ditch bottom. Because previous systems for cutting ditches tend to completely neglect backslopes, it has become increasingly common that backslopes are not cut properly to take into account both the angle of the backslopes to the ditch bottom and the gradual decrease in elevation over the length of the ditch.

SUMMARY

An example embodiment of the present invention is directed to an automated backslope cutting system. The automated backslope cutting system includes a scraper which is automatically adjusted by a computing device to effectuate cutting of backslopes for a ditch based on a desired cut profile. The desired cut profile may be manually entered by the operator and automatically processed by the computing device. The area is surveyed with a positioning sensor to determine an optimal desired cut profile which requires a minimum number of cuts. A proximity sensor may be provided to accommodate for rotational movement of the cutting blade as the scraper performs cuts. A control software is provided for execution by the computing device to provide functionality including the automatic adjustment of hydraulic actuators controlling movement of the cutting blade as the scraper cuts the ditch and backslopes.

There has thus been outlined, rather broadly, some of the features of the automated backslope cutting system in order that the detailed description thereof may be better understood, and in order that the present contribution to the art may be better appreciated. There are additional features of the automated backslope cutting system that will be described hereinafter and that will form the subject matter of the claims appended hereto. In this respect, before explaining at least one embodiment of the automated backslope cutting system in detail, it is to be understood that the automated backslope cutting system is not limited in its application to the details of construction or to the arrangements of the components set forth in the following description or illustrated in the drawings. The automated backslope cutting system is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

DETAILED DESCRIPTION

Figure 1:
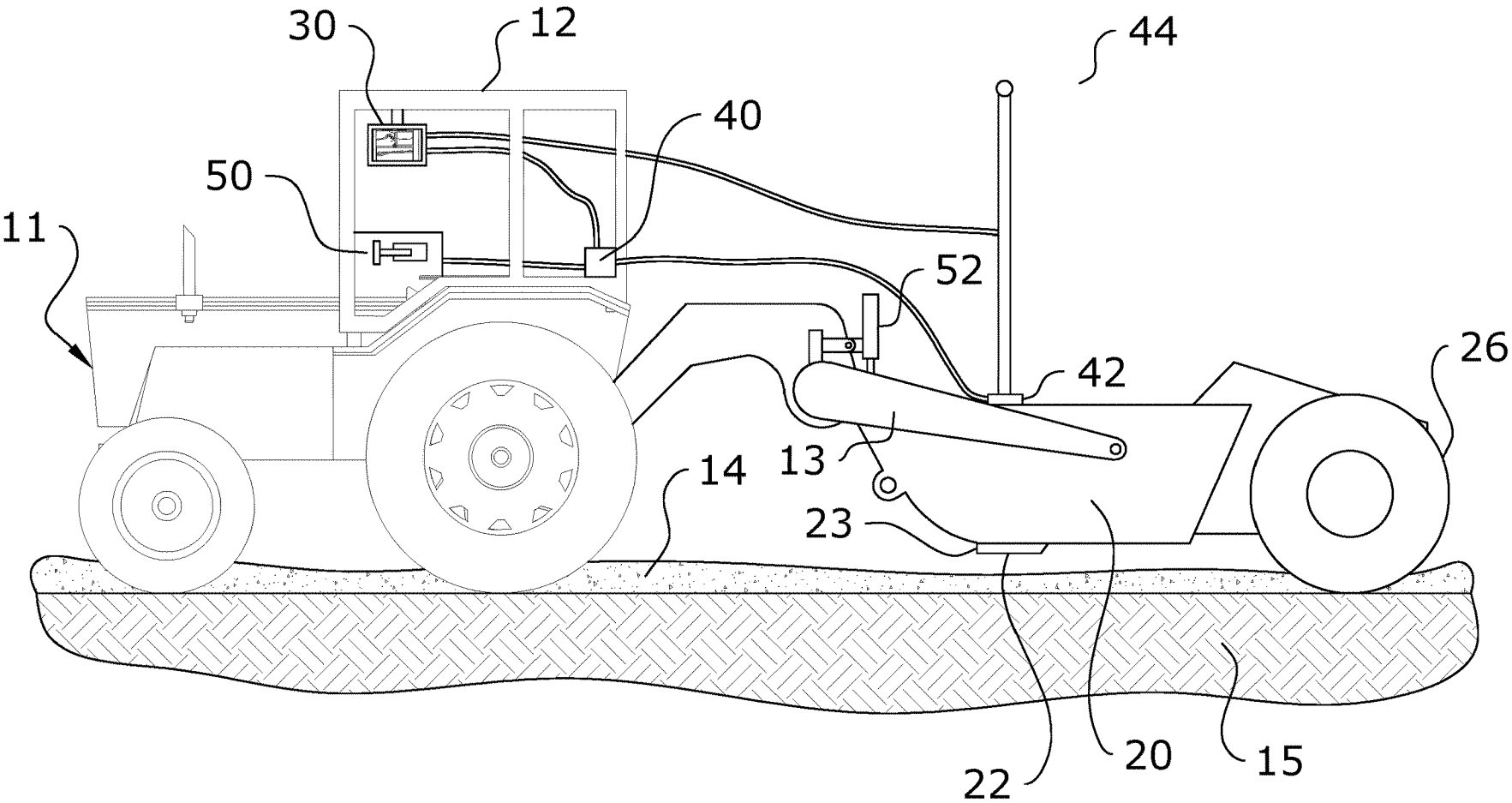
FIG. 1 is a side view of an automated backslope cutting system in accordance with an example embodiment.
Figure 2:
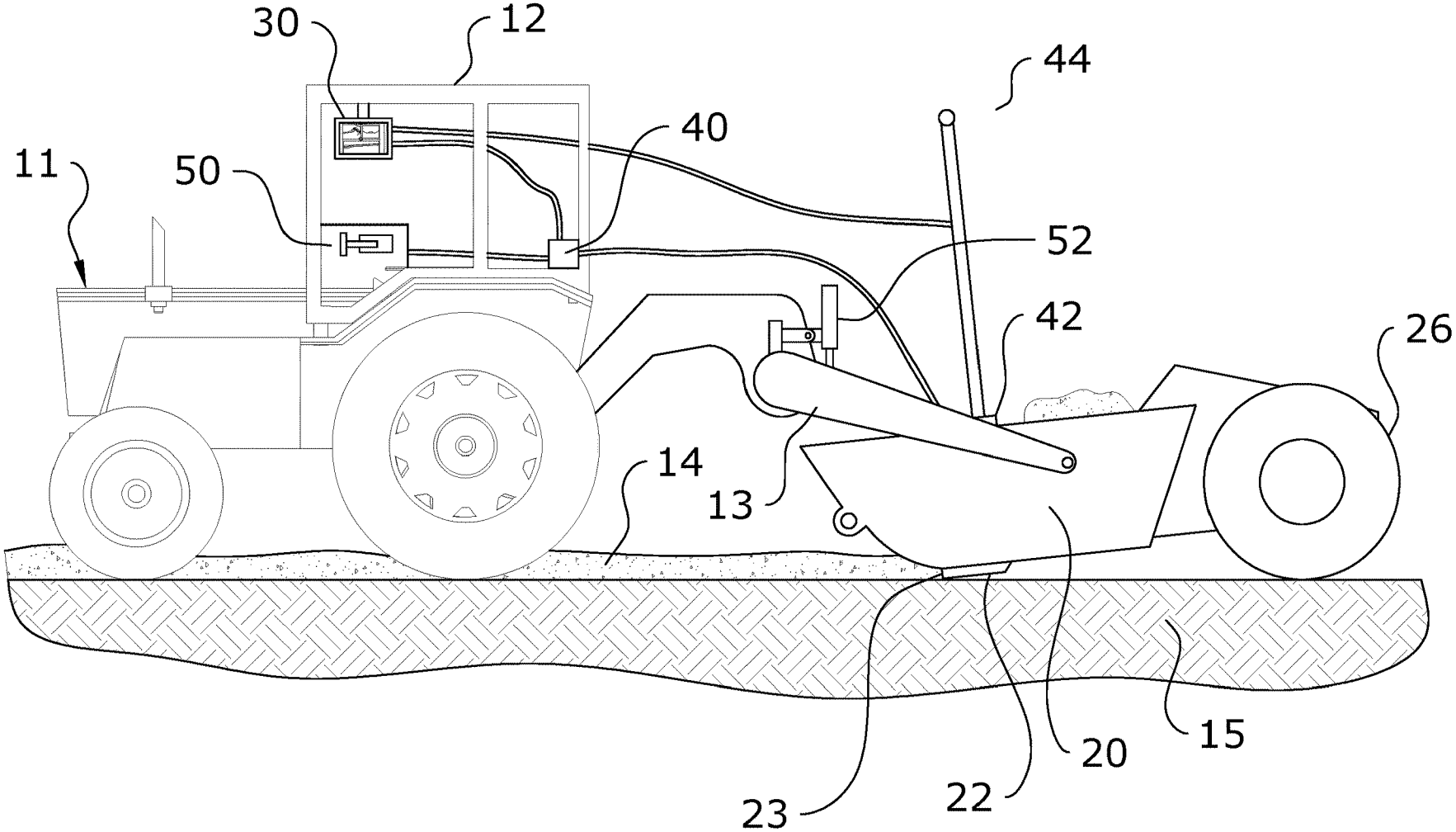
FIG. 2 is a side view of an automated backslope cutting system with its scraper lowered in accordance with an example embodiment.
Figure 3:
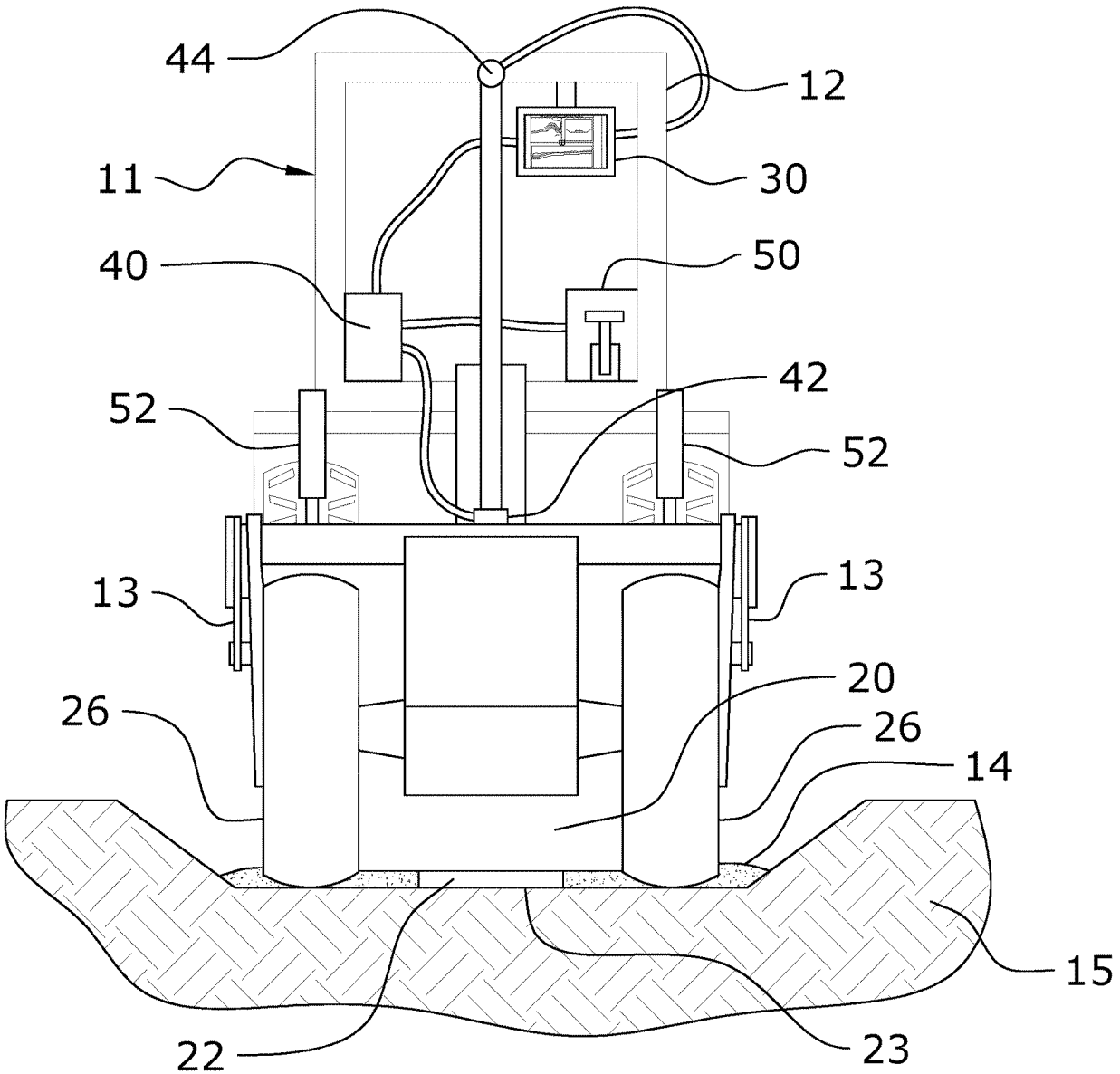
FIG. 3 is a rear view of an automated backslope cutting system with its scraper lowered in accordance with an example embodiment.

A. Overview.

An example automated backslope cutting system 10 generally includes a scraper 20 which is automatically adjusted by a computing device 30 to effectuate cutting of backslopes 18, 19 for a ditch 16 based on a desired cut profile. The desired cut profile may be manually entered by the operator and automatically processed by the computing device 30. The area is surveyed with a positioning sensor 44 to determine an optimal desired cut profile which requires a minimum number of cuts. A proximity sensor 42 may be provided to accommodate for rotational movement of the cutting blade 22 as the scraper 20 performs cuts. A control software 32 is provided for execution by the computing device 30 to provide functionality including the automatic adjustment of hydraulic actuators 52 controlling movement of the cutting blade 22 as the scraper 20 cuts the ditch 16 and backslopes 18, 19.

B. Exemplary Communications Networks.

The automated backslope cutting system 10 may be utilized upon any communications network capable of transmitting data including voice data and other types of electronic data. Examples of suitable communications networks for the automated backslope cutting system 10 include but are not limited to global computer networks (e.g. Internet), wireless networks, cellular networks, satellite communications networks, cable communication networks (via a cable modem), microwave communications network, local area networks (LAN), wide area networks (WAN), campus area networks (CAN), metropolitan-area networks (MAN), and home area networks (HAN). The automated backslope cutting system 10 may communicate via a single communications network or multiple communications networks concurrently. Various protocols may be utilized by the electronic devices for communications such as but not limited to HTTP, SMTP, FTP and WAP (wireless Application Protocol). The automated backslope cutting system 10 may be implemented upon various wireless networks such as but not limited to 3G, 4G, LTE, CDPD, CDMA, GSM, PDC, PHS, TDMA, FLEX, REFLEX, IDEN, TETRA, DECT, DATATAC, and MOBITEX. The automated backslope cutting system 10 may also be utilized with online services and internet service providers.

The Internet is an exemplary communications network for the automated backslope cutting system 10. The Internet is comprised of a global computer network having a plurality of computer systems around the world that are in communication with one another. Via the Internet, the computer systems are able to transmit various types of data between one another. The communications between the computer systems may be accomplished via various methods such as but not limited to wireless, Ethernet, cable, direct connection, telephone lines, and satellite.

C. Scraper.

The methods and systems disclosed herein relate to automated operation of a scraper 20 based on a cut profile for a ditch 16. More specifically, the methods and systems disclosed herein relate to automated operation of the scraper 20 to form one or more backslopes 18, 19 of the ditch 16 based on a survey of the ground surface 15 of the desired ditch 16 and any user inputs into a computing device 30 running control software 32.

The methods and systems disclosed herein may be utilized on any number of scrapers 20. FIGS. 1-4 illustrate an exemplary scraper 20 which is adapted to be towed by a vehicle 11 such as a tractor. It should be appreciated that the scraper 20 shown in FIGS. 1-4 is merely for illustrative purposes, and should not be construed as limiting on the scope of the present invention. Various different types of scrapers 20 may be utilized with the methods and systems herein, as the methods and systems are adapted to be utilized with any type of scraper 20, including scrapers 20 adapted to be towed or pushed by a vehicle 11 or scrapers 20 which are integrated with a vehicle 11.

The exemplary scraper 20 shown in FIGS. 1-4 is towed by a vehicle 11. The vehicle 11 includes a cabin 12 in which the operator will sit while operating the vehicle 11 and scraper 20. A pair of arms 13 extend from the vehicle 11 to which the scraper 20 may be removably connected. As shown in the figures, the scraper 20 is removably mounted to the arms 13 so that the scraper 20 may be towed by the vehicle 11 when scraping a ditch 16. The scraper 20 may include wheels 26 which allow it to traverse the ground surface 15 while being pushed or pulled by the vehicle 11.

The scraper 20 will generally comprise a cutting blade 22 which may be adjusted via hydraulic actuators 52. The cutting blade 22 is adapted to cut the ground surface 15 to remove graded materials 14 from the ground surface 15 when creating a ditch 16. The cutting blade 22 shown in the figures is merely for illustrative purposes, and various other types of cutting blades 22 may be utilized with the systems and methods described herein.

The cutting blade 22 will generally include a cutting edge 23 at its lower end. The cutting edge 23 is adapted to cut into the ground surface 15 to remove graded materials 14. The scraper 20 may include an integrated storage vessel (such as a scraper box), may feed into a separate storage vessel, or may simply push the graded materials 14 out of the way for retrieval later. In any case, the cutting edge 23 may be moved, such as vertically, horizontally, or rotationally, by the hydraulic actuators 52 in response to instructions received from the computing device 30.

D. Computing Device.

Various functionalities of the methods and systems described herein are performed by a computing device 30 which executes a control software 32. Various types of computing devices 30 may be utilized, including remote, such as by communicating via a communications network or other communication protocols such as BLUETOOTH or the like, or on-site, such as located within the cabin 12 of the vehicle 11 as shown in the figures.

The exemplary figures illustrate an embodiment in which the computing device 30 is positioned within the cabin 12 with electrical cables 34 interconnecting the computing device 30 with a digital-to-analog converter 40, a proximity sensor 42, a positional sensor 44, and a hydraulic controller 50. It should be appreciated that any, none, or all of the connections between the computing device 30 and any other component of the system described herein may be wireless in some embodiments. Thus, it should not be construed that electrical cables 34 are necessary for any interconnection, as connections between devices is increasingly being performed by wireless communications.

The computing device 30 may both transmit and receive data with the digital-to-analog converter 40 where a separate digital-to-analog converter 40 is utilized. The computing device 30 will generally receive data from the positional sensor 44 so that the computing device 30 may receive and process positional data of the scraper 20.

Figure 5:
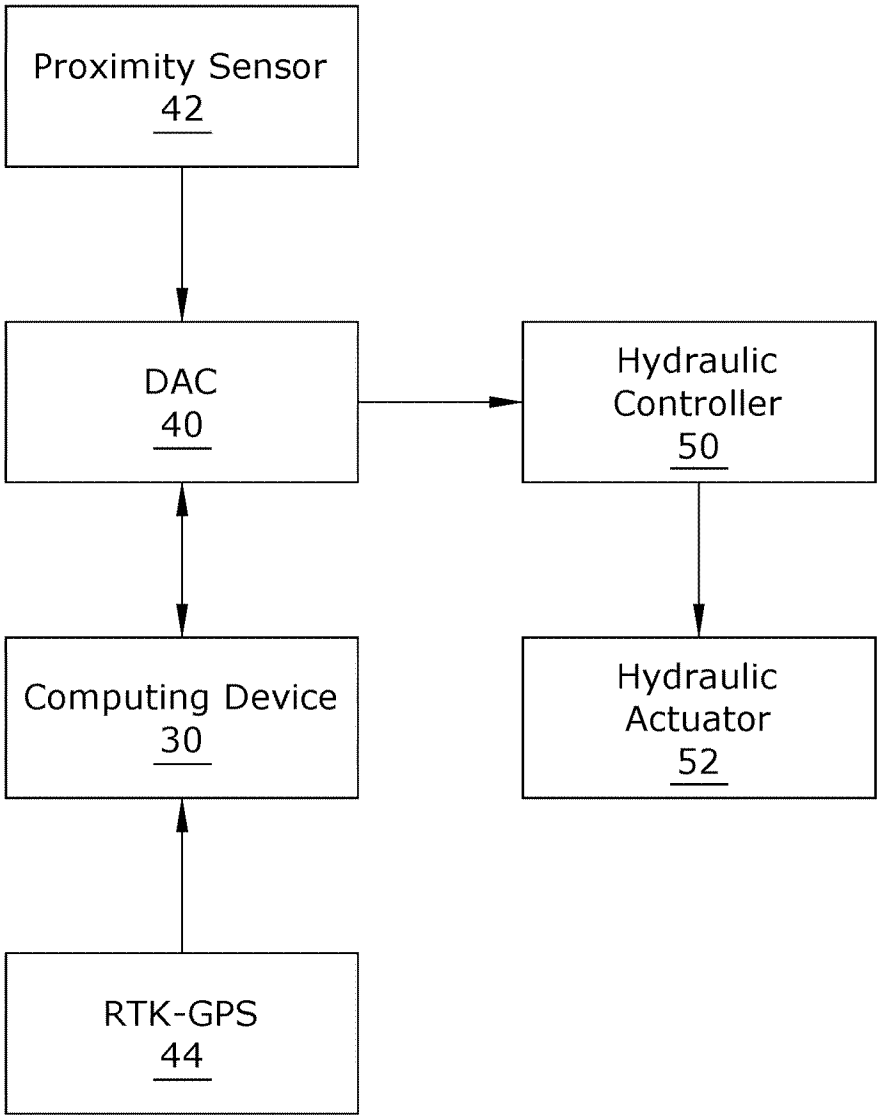
FIG. 5 is a block diagram of an automated backslope cutting system in accordance with an example embodiment.
Figure 6:
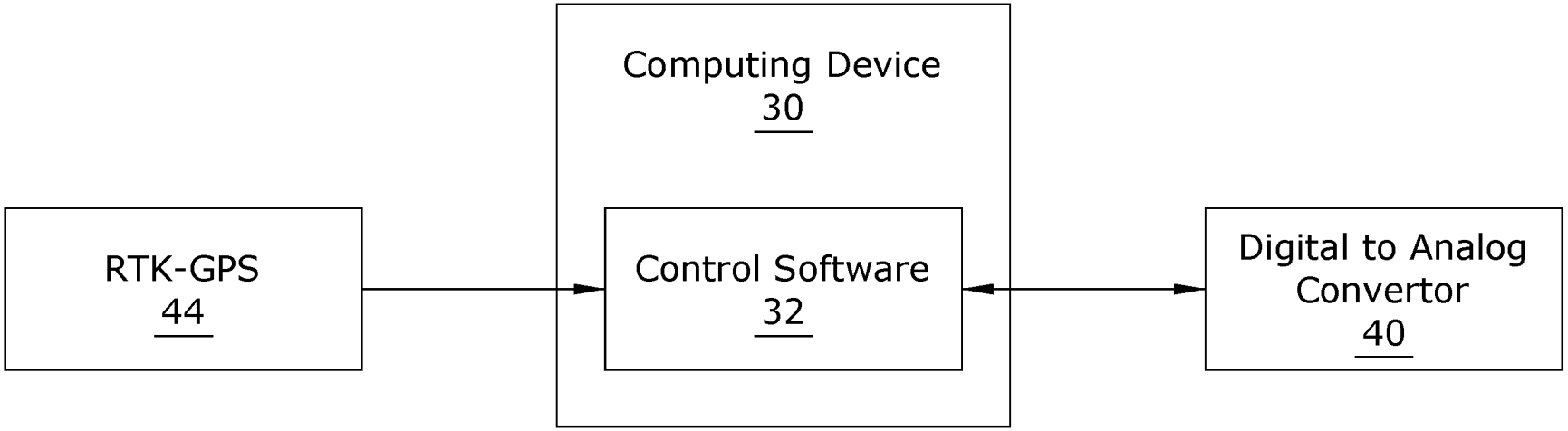
FIG. 6 is a block diagram illustrating interconnection between an exemplary computing device, positioning sensor, and digital-to-analog converter of an automated backslope cutting system in accordance with an example embodiment.

As best shown in FIGS. 5 and 6, the positional sensor 44 is connected to an input of the computing device 30 so that the positional sensor 44 may transmit positional data, such as elevation readings, to the computing device 30. The computing device 30 then analyzes this positional data and directs movement of the scraper 20 via the hydraulic actuators 52.

The digital-to-analog converter 40 is connected to an output of the computing device 30 so that the computing device 30 may transmit a signal to the digital-to-analog converter 40 directing the adjustment of the scraper 20 based on several parameter settings in the control software 32 being executed on the computing device 30.

The computing device 30 includes a display 60 which displays the various screens of the control software 32. The display 60 may be integrated with the computing device 30 or may be separate. Preferably, a touch-screen display 60 will be utilized so that inputs to the computing device 30 may be provided via touch. The exemplary screens shown on the display 60 in the figures should not be construed as limiting, as the style and configuration of screens displayed to an operator will vary in different embodiments.

FIGS. 1-4 illustrate a digital-to-analog converter 40 positioned within the cabin 12 of the vehicle 11 and connected to the computing device 30, the proximity sensor 42, and the hydraulic controller 50 via electrical cables 34. Any of these interconnections could be made wirelessly in some embodiments. The digital-to-analog converter 40 inputs and outputs data for the hydraulic controls 50; primarily converting analog to digital and digital to analog as needed. The digital-to-analog converter 40 will preferably input and output multiple channels of data.

In some embodiments, the digital-to-analog converter 40 may be positioned externally of the cabin 12, either on the vehicle 11 or the scraper 20. In other embodiments, the digital-to-analog converter 40 may be integrated with the computing device 30; with the computing device 30 performing all of the functions of the digital-to-analog converter 40.

As best shown in FIG. 5, the proximity sensor 42 may be communicatively interconnected with the input of the digital-to-analog converter 40 to receive and convert data which is being transmitted from the proximity sensor 42 to the computing device 30. The computing device 30 itself is also communicatively interconnected with the input of the digital-to-analog converter 40 to transmit instructions from the computing device 30 to the hydraulic actuators 52 via the hydraulic controller 50.

The computing device 30 will also preferably be communicatively interconnected with the output of the digital-to-analog converter 40 to transmit converted data from the proximity sensor 42 to the computing device 30. The hydraulic controller 50 will also preferably be communicatively interconnected with the output of the digital-to-analog converter 40 so that the digital-to-analog converter 40 may transmit signals to extend or retract the hydraulic actuators 52 that are received from the computing device 30.

The computing device 30 may be comprised of any type of computer for practicing the various aspects of the automated backslope cutting system 10. For example, the computing device 30 can be a personal computer (e.g. APPLE® based computer, an IBM based computer, or compatible thereof) or tablet computer (e.g. IPAD®). The computing device 30 may also be comprised of various other electronic devices capable of sending and receiving electronic data including but not limited to smartphones, mobile phones, telephones, personal digital assistants (PDAs), mobile electronic devices, handheld wireless devices, two-way radios, smart phones, communicators, video viewing units, television units, television receivers, cable television receivers, pagers, communication devices, and digital satellite receiver units.

The computing device 30 may be comprised of any conventional computer. A conventional computer preferably includes a display screen (or monitor), a printer, a hard disk drive, a network interface, and a keyboard. A conventional computer also includes a microprocessor, a memory bus, random access memory (RAM), read only memory (ROM), a peripheral bus, and a keyboard controller. The microprocessor is a general-purpose digital processor that controls the operation of the computer. The microprocessor can be a single-chip processor or implemented with multiple components. Using instructions retrieved from memory, the microprocessor controls the reception and manipulations of input data and the output and display of data on output devices. The memory bus is utilized by the microprocessor to access the RAM and the ROM. RAM is used by microprocessor as a general storage area and as scratch-pad memory, and can also be used to store input data and processed data. ROM can be used to store instructions or program code followed by microprocessor as well as other data. A peripheral bus is used to access the input, output and storage devices used by the computer. In the described embodiments, these devices include a display screen, a printer device, a hard disk drive, and a network interface. A keyboard controller is used to receive input from the keyboard and send decoded symbols for each pressed key to microprocessor over bus. The keyboard is used by a user to input commands and other instructions to the computer system. Other types of user input devices can also be used in conjunction with the automated backslope cutting system 10. For example, pointing devices such as a computer mouse, a track ball, a stylus, or a tablet to manipulate a pointer on a screen of the computer system. The display screen is an output device that displays images of data provided by the microprocessor via the peripheral bus or provided by other components in the computer. The printer device when operating as a printer provides an image on a sheet of paper or a similar surface. The hard disk drive can be utilized to store various types of data. The microprocessor together with an operating system operate to execute computer code and produce and use data. The computer code and data may reside on RAM, ROM, or hard disk drive. The computer code and data can also reside on a removable program medium and loaded or installed onto computer system when needed. Removable program mediums include, for example, CD-ROM, PC-CARD, USB drives, floppy disk and magnetic tape. The network interface circuit is utilized to send and receive data over a network connected to other computer systems. An interface card or similar device and appropriate software implemented by microprocessor can be utilized to connect the computer system to an existing network and transfer data according to standard protocols.

E. Positional and Proximity Sensors.

The methods and systems described herein may rely on proximity and/or positional sensors 42, 44 which feed information to the computing device 30 regarding the navigation, elevation, angle, and other aspects of the scraper 20. This information is utilized by the computing device 30 in combination with the control software 32 to perform the various functions of the methods and systems described herein.

The positional sensor 44 is provided to detect the elevation, position, and navigation of the scraper 20. The positional sensor 44 in some embodiments may comprise a GPS receiver. In a preferred embodiment, the positional sensor 44 comprises a real time kinematic GPS receiver for increased accuracy.

The positional sensor 44 may be located anywhere on the scraper 20, but will preferably be positioned near the cutting blade 22. The positional sensor 44 may be positioned on a raised mast as shown in the figures, which allows the positional sensor 44 to be at an elevated position to reduce interference and ensure accurate communications with overhead satellites. The positional sensor 44 will both detect the location of the scraper 20 as well as the elevation of the cutting blade 22.

Some embodiments may also utilize a proximity sensor 42 in combination with the positional sensor 44. The proximity sensor 42 is preferably positioned on the scraper 20 itself. Any type of positional sensor 44 capable of detecting rotational movement or changes in elevation of an object and transmitting that information to a computing device 30 may be utilized. The figures illustrate that the proximity sensor 42 and the positional sensor 44 are stacked—this is merely an optional configuration and should not be construed as necessary for functionality of the methods and systems described herein.

Figure 4:
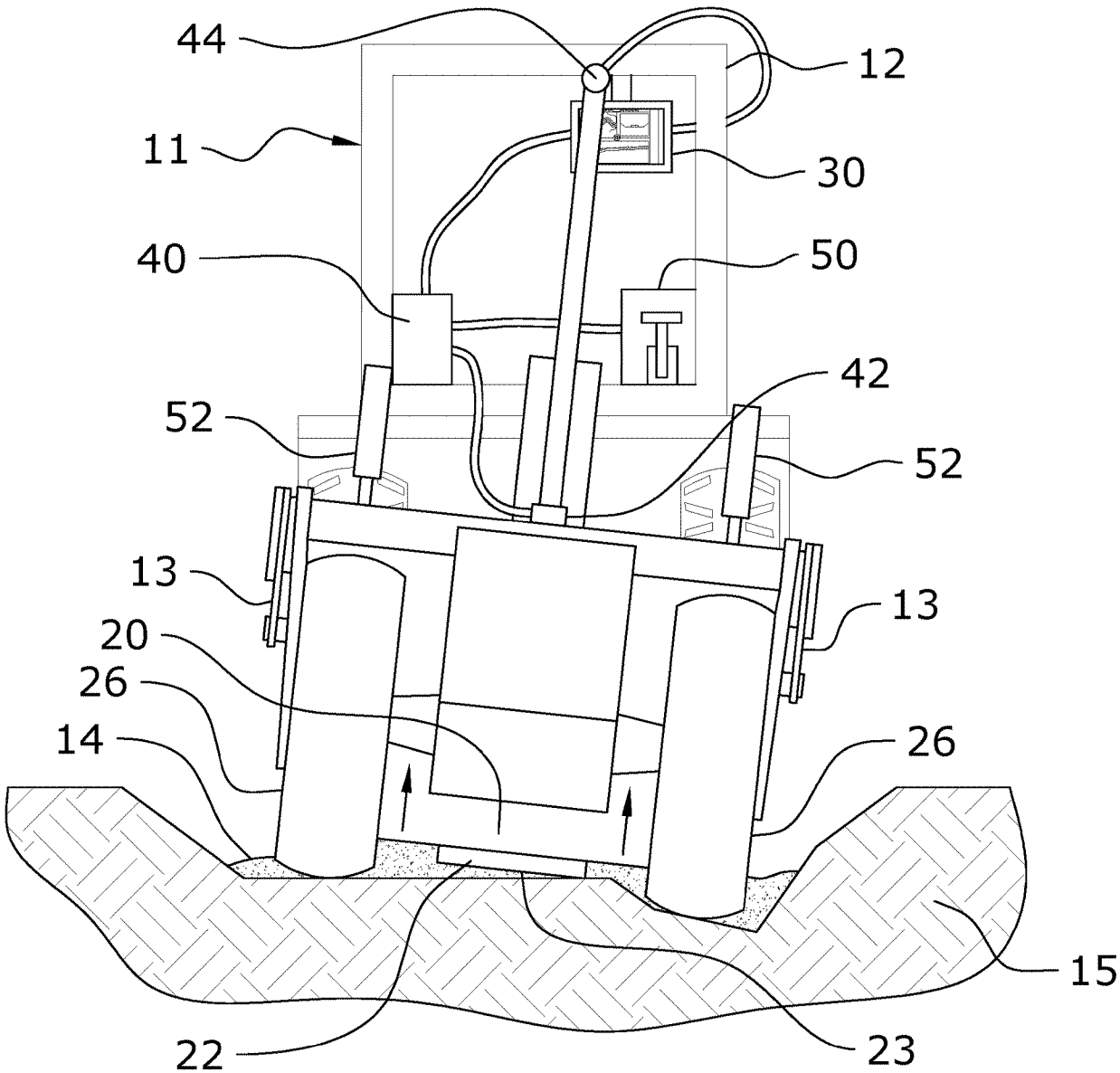
FIG. 4 is a rear view of an automated backslope cutting system illustrating adjustment of the scraper blade due to sensed rotation in accordance with an example embodiment.

The proximity sensor 42 measures the side-to-side rotation of the cutting blade 22 to prevent the corners of the scraper 20 from going too deep. When the scraper 20 is in use, the wheels 26 passing over the ground surface 15 may influence the scraper 20 such that the cutting blade 22 rotates as shown in FIG. 4. Rough ground surfaces 15 tend to affect the cutting blade 22 more when the scraper 20 is empty and soft muddy ground surfaces 15 tend to affect the cutting blade 22 more when the scraper 20 is full.

The proximity sensor 42 provides the computing device 30 with values so that the lowest point of the cutting blade 22 (its cutting edge 23) may be continuously calculated. Rotation of the scraper 20 from side-to-side can change the elevation of the corners of the cutting blade 22 by several inches in some circumstances. The proximity sensor 42 provides data to the computing device 30 so that the computing device 30 can respond to this rocking side-to-side motion and keep the cutting blade 22 from gouging or taking too much soil. These types of faults could create divots or holes that would hold water; which would be counterintuitive to forming the ditch.

F. Hydraulics.

As shown throughout the figures, hydraulics are utilized to raise and lower the scraper 20. As shown in FIGS. 1-4, hydraulic actuators 52 are connected to the scraper 20 such that extension and/or retraction of the hydraulic actuators 52 raises and/or lowers the scraper 20. Various types of actuators 52 may be utilized. Although the term hydraulic is used throughout, it should be appreciated that, in some embodiments, the actuators 52 may be electric.

A hydraulic controller 50 will generally directly control the extension and/or retraction of the hydraulic actuators 52 based on operator input via manual controls or based on automated instructions from the computing device 30. The cutting blade 22 of the scraper 20 is raised up and down relative to the data transmitted to the computing device 30 from the proximity and/or positional sensors 42, 44. The signals from the computing device 30 to the hydraulic controller 50 which direct movement of the hydraulic actuators 52 to adjust the cutting blade 22 are created by mathematical processes and algorithms within the control software 32 being executed by the computing device 30.

G. Operation of Preferred Embodiment.

The methods and systems described herein relate to the formation of a ditch 16 by automated adjustment of a scraper 20 by a computing device 30. The types of ditches 16 formed with the methods and systems described herein may vary in different embodiments. Thus, the scope of the present invention should not be construed as limited to any particular ditch 16 by the exemplary figures.

Generally, a ditch 16 will include a ditch bottom 17 which gradually loses elevation in the direction of waterflow. A first backslope 18 generally extends angularly upward from a first side of the ditch bottom 17 and a second backslope 19 generally extends angularly upward from a second side of the ditch bottom 17. Some ditches 16 may include only a single backslope 18.

Each backslope 18, 19 comprises the slope or grade of the side of a ditch 16 that is perpendicular to the direction of water travel. For purposes of the methods and systems described herein, a backslope value is representative of a ratio of rise of the shoulder of the ditch 16 to the distance from the ditch bottom 17. This ratio of rise to distance provides the backslope value which defines the slope of the backslopes 18, 19. For example, a backslope value of 1:20 would mean a one foot rise over 20 feet of distance. A backslope value of 1:50 would mean a one foot rise over 50 feet of distance.

It should be appreciated that the methods and systems described herein are capable of automating both creation of the ditch bottom 17 but also creation of the backslopes 18, 19 of the ditch 16. Previous systems have not provided this functionality; leading to ditches 16 often having improperly formed backslopes 18, 19.

The methods and systems described herein will ensure that the backslope value remains constant over course of the gradual decline in elevation of the ditch 16. Different backslope values are supported, such as in a case where the first backslope 18 is to be a first backslope value and the second backslope 19 is to be a second backslope value. Further, the methods and systems described herein can support changes in backslope angle over a single backslope 18, supporting multiple-slopes within a single backslope 18.

i. Control Software.

The methods and systems described herein will generally be performed by a computing device 30 operating a control software 32. The control software 32 provides the calculations, processes, and algorithms for the computing device 30 to direct the overall operation of the present invention. The control software 32 may run on any type of operating system and should be adapted to work on any number of computing devices 30.

FIGS. 7*a*-17 illustrate various displays 60 which are shown by the computing device 30 as instructed by the control software 32. These displays 60 are merely exemplary and should not be construed as limiting in any manner whatsoever. The style and orientation of the various elements shown in the display 60 will vary in different embodiments, and the figures are merely for exemplary purposes.

Figure 7A:
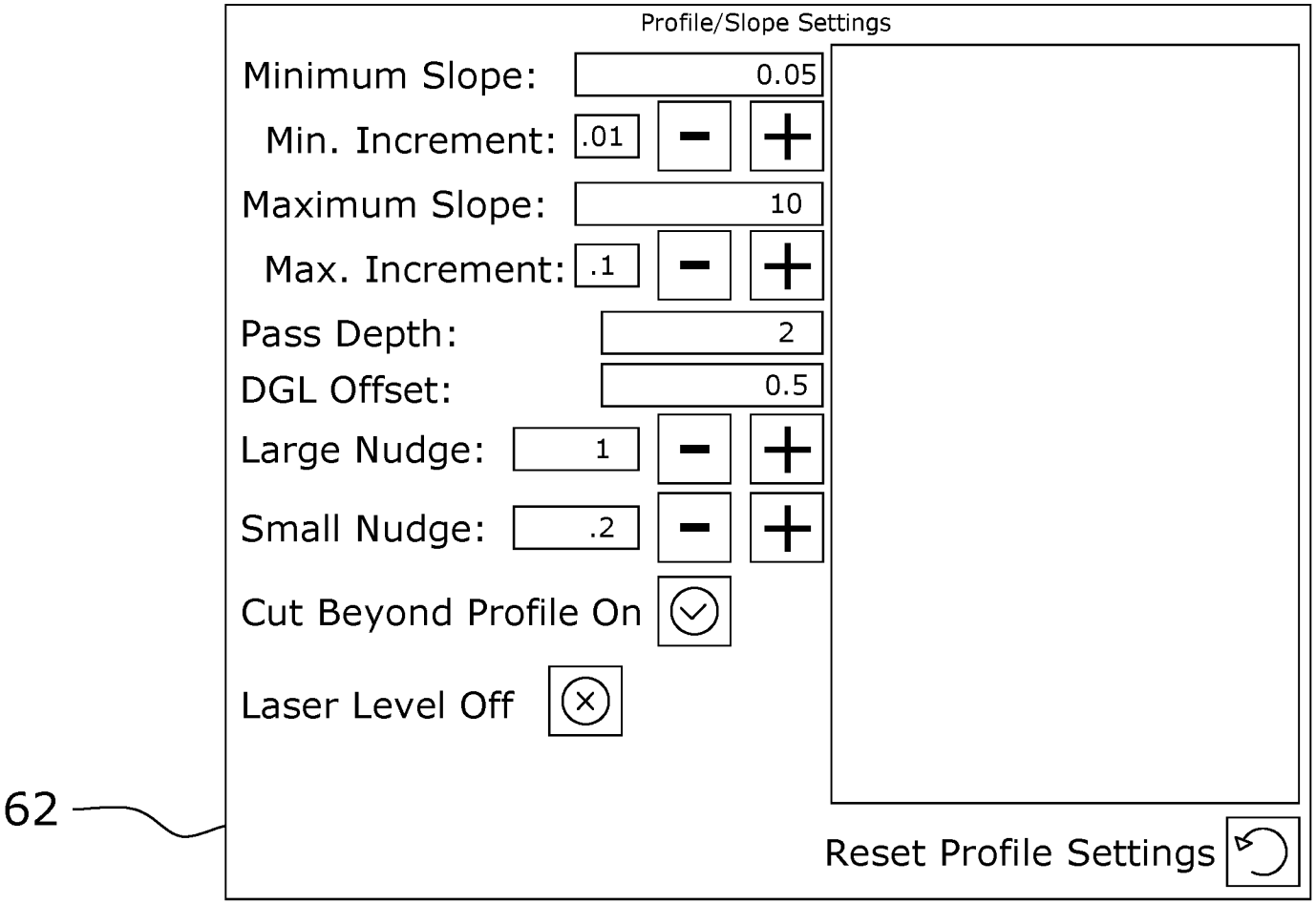
FIG. 7*a* is an illustrative view of an exemplary slope settings display of an automated backslope cutting system in accordance with an example embodiment.

FIG. 7*a* shows an exemplary profile/slope settings display 62. The profile/slope settings display 62 is utilized by the computing device 30 to receive operator-inputted settings related to the ditch 16 being cut. Exemplary settings which may be included in the profile/slope settings display 62 include the minimum slope of the ditch 16, the minimum increment of the ditch 16, the maximum slope of the ditch 16, and the maximum increment of the ditch 16.

Figure 18:
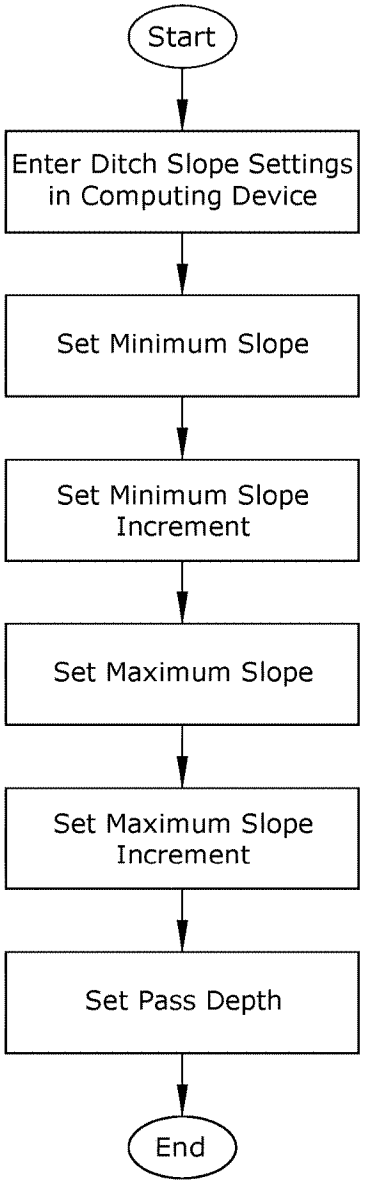
FIG. 18 is a flowchart illustrating entry of ditch slope settings into the computing device by an automated backslope cutting system in accordance with an example embodiment.

The profile/slope settings display 62 may also include additional settings for operator input including the pass depth, DGL offset, large nudge, and small nudge. Various other settings may be provided on this screen, or this screen may be combined with various other screens described or shown herein. Upon first beginning a ditching operation, these settings will generally be manually input into the computing device 30 by the operator. FIG. 18 illustrates an exemplary method of entering ditch slope settings on the profile/slope settings display 62.

Figure 7B:
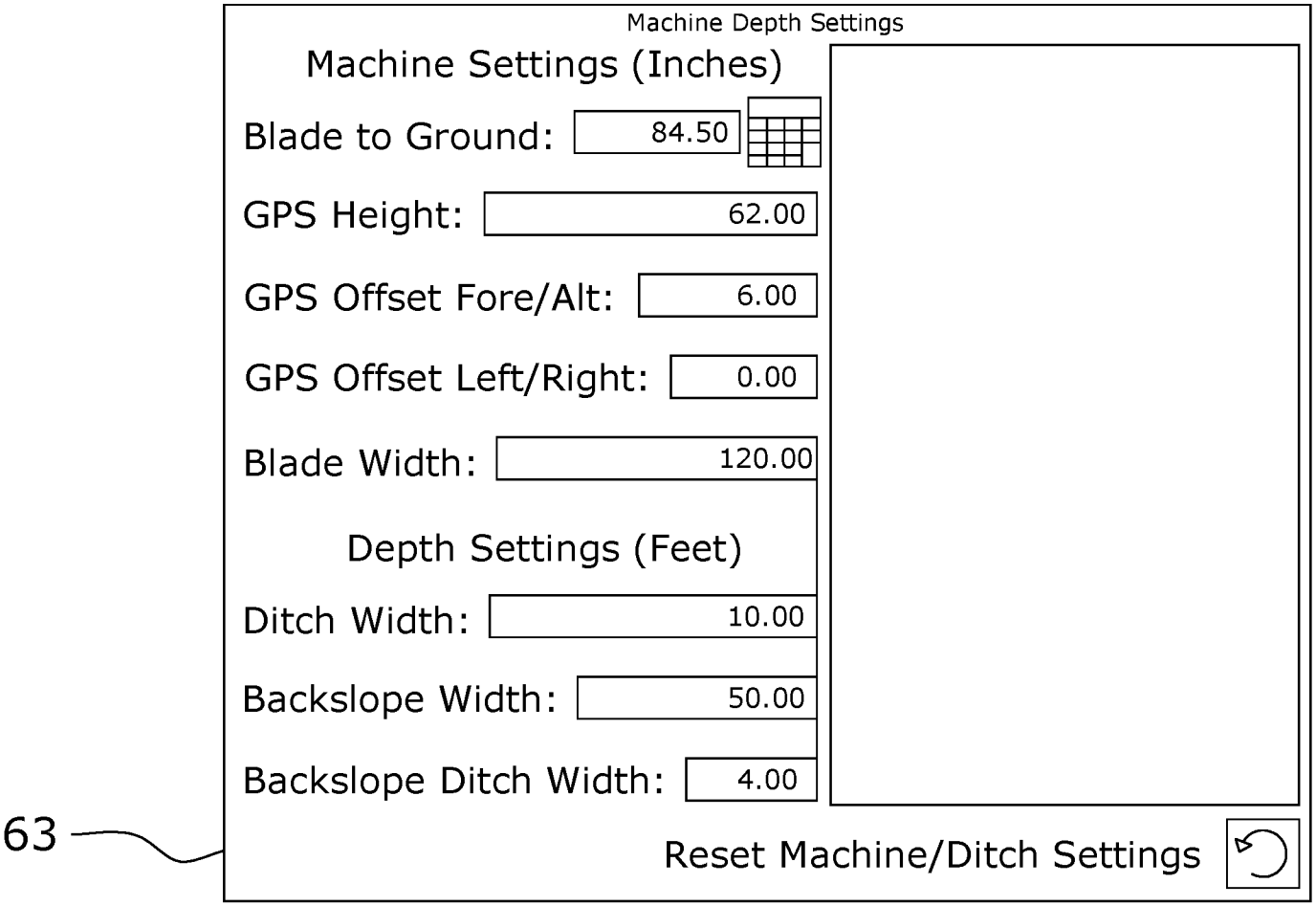
FIG. 7*b* is an illustrative view of an exemplary machine depth settings display of an automated backslope cutting system in accordance with an example embodiment.

FIG. 7*b* shows an exemplary machine depth settings display 63. These settings provide information relating to the scraper 20 being utilized to the computing device 30. As scrapers 20 vary in construction, this information will need to be manually input by the operator for each scraper 20 the methods and systems described herein are utilized with. Exemplary settings to be manually input by the operator on this display 63 include the distance from the cutting blade 22 to the ground surface 15, the height and orientation of the positional sensor 44, and the width of the cutting blade 22.

Figure 19:
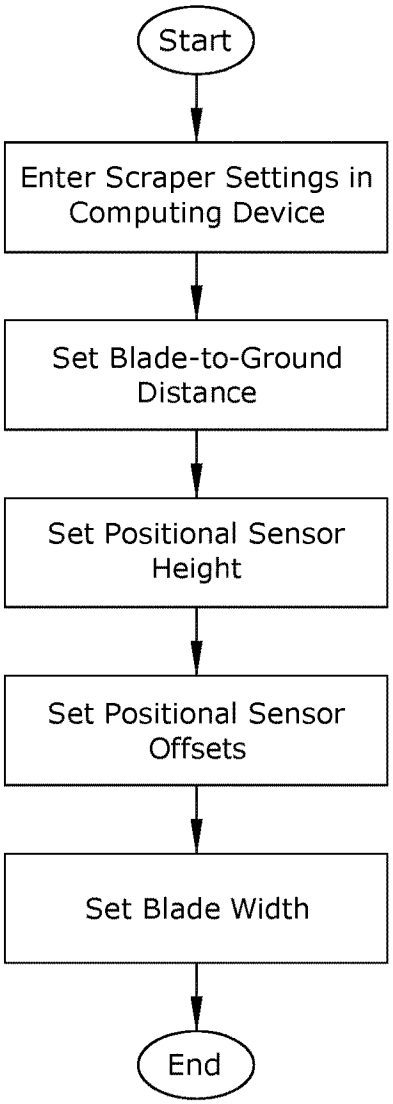
FIG. 19 is a flowchart illustrating entry of scraper settings into the computing device of an automated backslope cutting system in accordance with an example embodiment.
Figure 20:
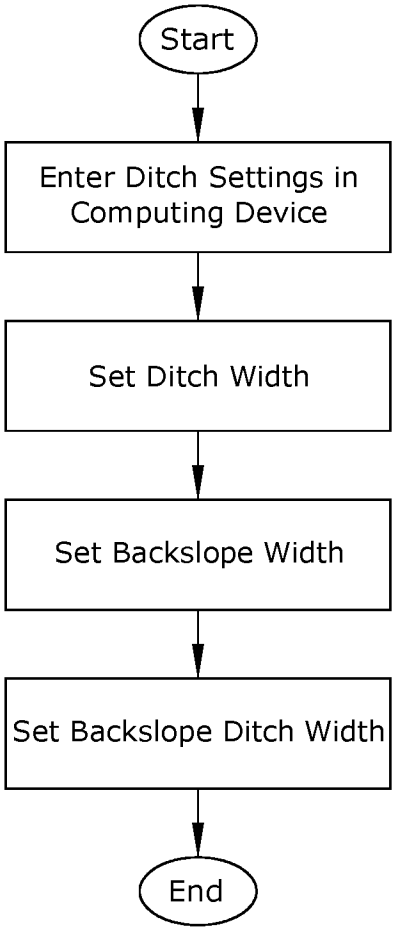
FIG. 20 is a flowchart illustrating entry of ditch and backslope settings into the computing device by an automated backslope cutting system in accordance with an example embodiment.

The machine depth settings display 63 may also integrate settings for the backslope, or these settings may be set on other screens of the computing device 30. In the exemplary embodiment of FIG. 7*b*, the machine depth settings display 63 includes input fields to receive the ditch width, backslope width, and backslope ditch width. These settings are utilized by the computing device 30 to ensure proper formation of the backslopes 18, 19 when using the methods and systems described herein. FIGS. 19 and 20 illustrate exemplary methods of entering these settings on the machine depth settings display 63.

Figure 8:
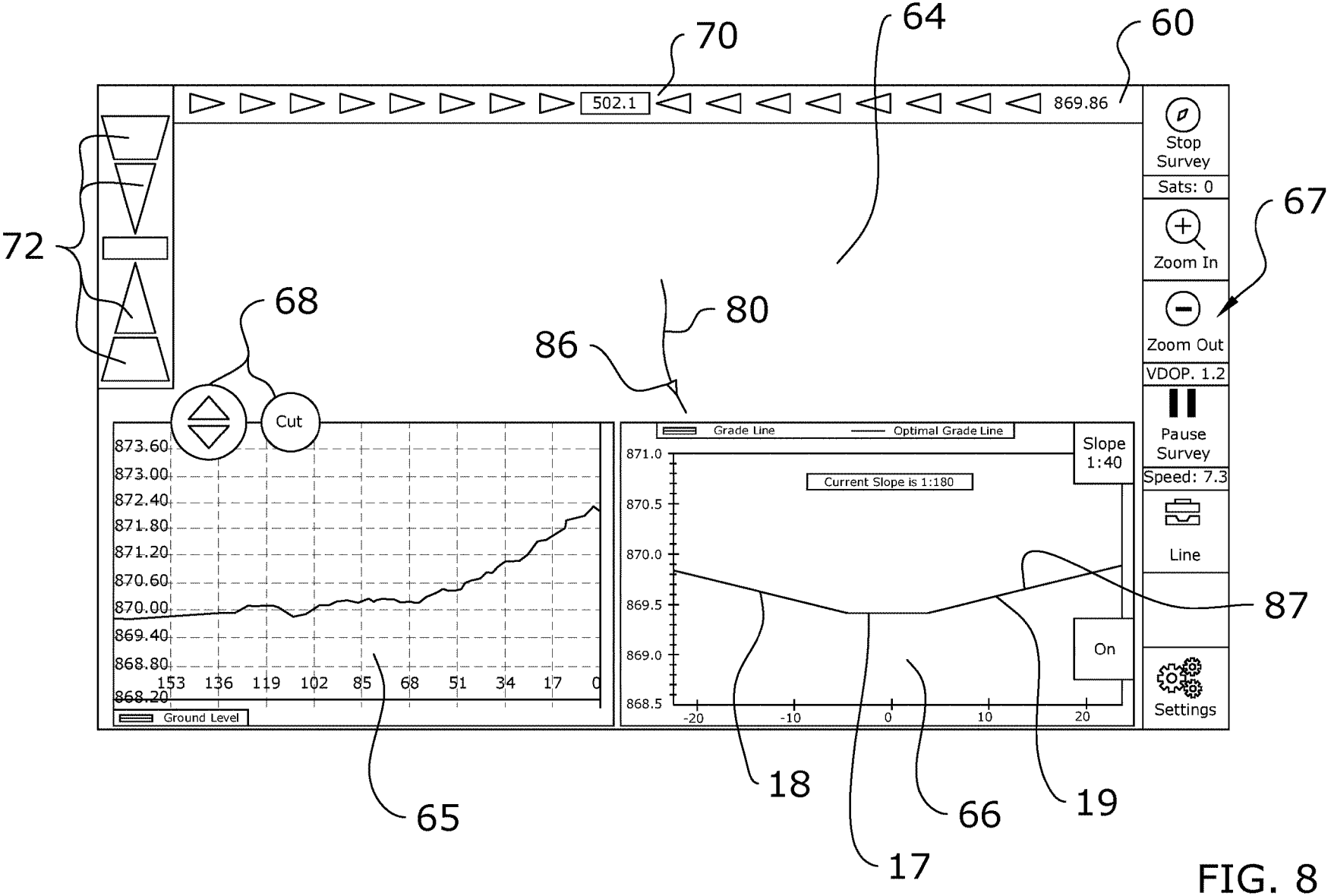
FIG. 8 is an illustrative view of a main display in surveying mode of an automated backslope cutting system in accordance with an example embodiment.

FIG. 8 illustrates an exemplary main display 60 which is generated by the control software 32 and displayed on the computing device 30. The display 60 includes a map window 64 which shows an overhead view of the area being worked. The display 60 also includes a side view window 65 showing a side view of the area being worked and showing the elevations of the ground surface 15. The display 60 also includes a backslope view window 66 which shows a frontal view of the ditch 16 including the ditch bottom 17 and backslopes 18, 19.

A control panel 67 is shown on the main display 60 which includes a plurality of options for controlling the computing device 30. These are merely examples and should not be construed as limiting. Exemplary options on the control panel 67 include a toggle for surveying, a toggle for backsloping, zooming features, navigational information such as speed, and a settings option.

The main display 60 may also include a plurality of selector buttons 68 which provide various functionalities. Exemplary selector buttons 68 are shown in FIG. 8 and should not be construed as limiting. Examples include selector buttons 68 for adjusting the various views 64, 65, 66 or for performing various other functions like initiating a cut.

The main display 60 may also include a directional status bar 70 as shown in the figures. The directional status bar 70 will continuously display the distance and direction from the location of the scraper 20 to the original survey line 80 which extends along the ditch bottom 17. The directional status bar 70 thus aids in displaying to the user a constant update on the location of the scraper 20 and the direction and distance from the scraper 20 to the ditch bottom 17.

The main display 60 may also include manual adjustment controls 72 which are utilized to manually adjust the elevation of the cutting blade 22. By selecting the upward or downward arrows, the operator may manually adjust the cutting blade 22 as needed during use. The manual adjustment controls 72 are generally utilized to raise the cutting blade 22 prior to surveying as discussed herein.

ii. Surveying.

As a first step for use of an example embodiment of the present invention, the ground surface 15 to be formed into the ditch 16 is first surveyed by the positional sensor 44 by moving the scraper 20 across the ground surface 15 to be formed into the ditch 16. Generally, the scraper 20 will be moved along the area to be ditched in the direction of waterflow, from high to low, as the positional sensor 44 relays positional data to the computing device 30.

Figure 21:
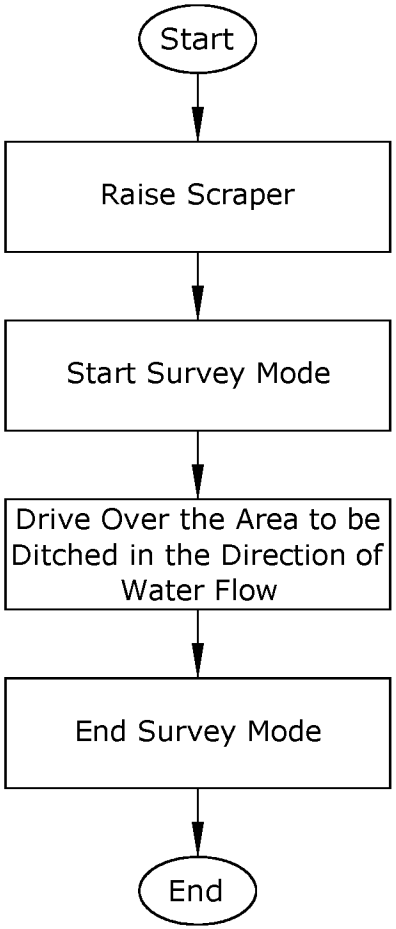
FIG. 21 is a flowchart illustrating the surveying of an area by an automated backslope cutting system in accordance with an example embodiment.
Figure 22:
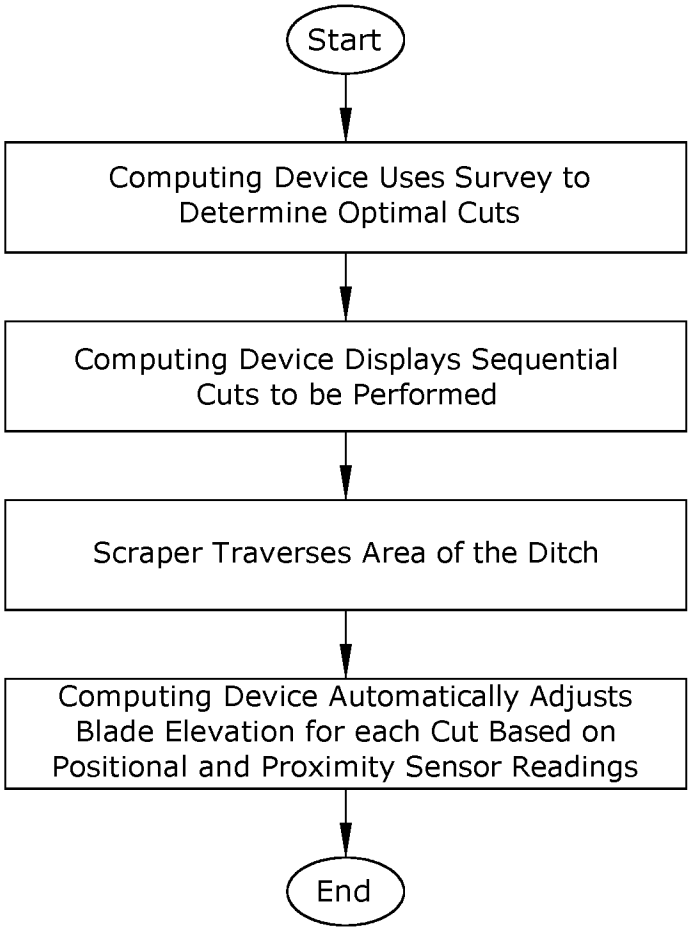
FIG. 22 is a flowchart illustrating multiple cuts being used to scrape a ditch by an automated backslope cutting system in accordance with an example embodiment.
Figure 23:
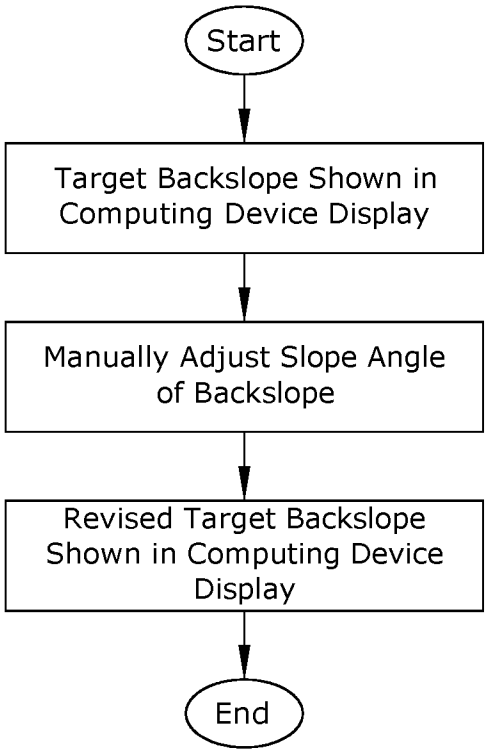
FIG. 23 is a flowchart illustrating adjustment of backslope angle by an automated backslope cutting system in accordance with an example embodiment.

FIG. 21 illustrates an exemplary method for surveying an area. First, survey mode may be entered by using the display 60 of the computing device 30. This instructs the computing device 30 to enter surveying mode and record data received from the positioning sensor 44. The scraper 20 is moved along the area to be ditched from wet area to outlet. The survey mode may then be disabled using the display 60 of the computing device 30 and the computing device 30 will automatically process the data of the area to be ditched to form a desired cut profile based on the ditch settings entered by the operator previously.

Figure 9:
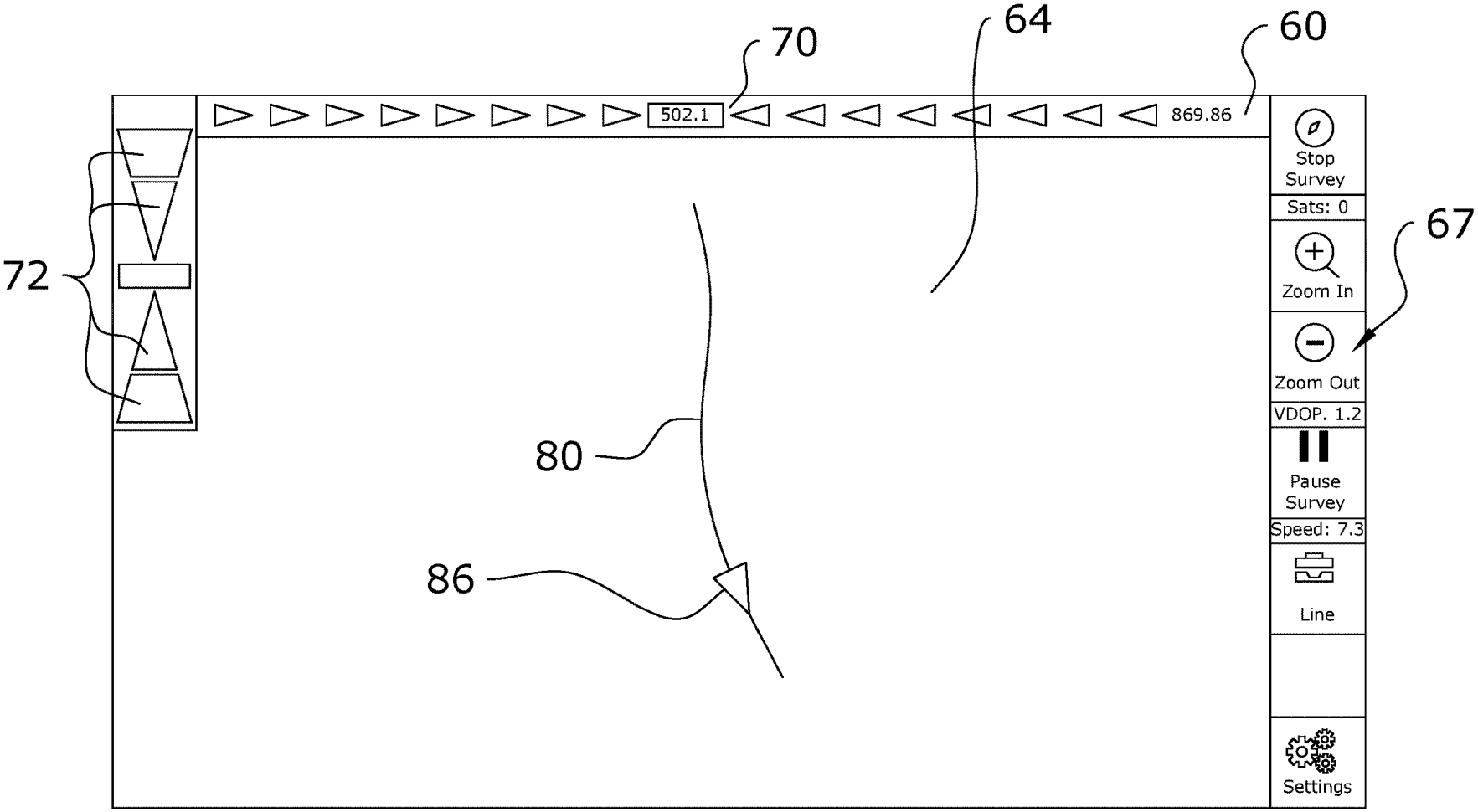
FIG. 9 is an illustrative view of a map display in surveying mode of an automated backslope cutting system in accordance with an example embodiment.
Figure 10:
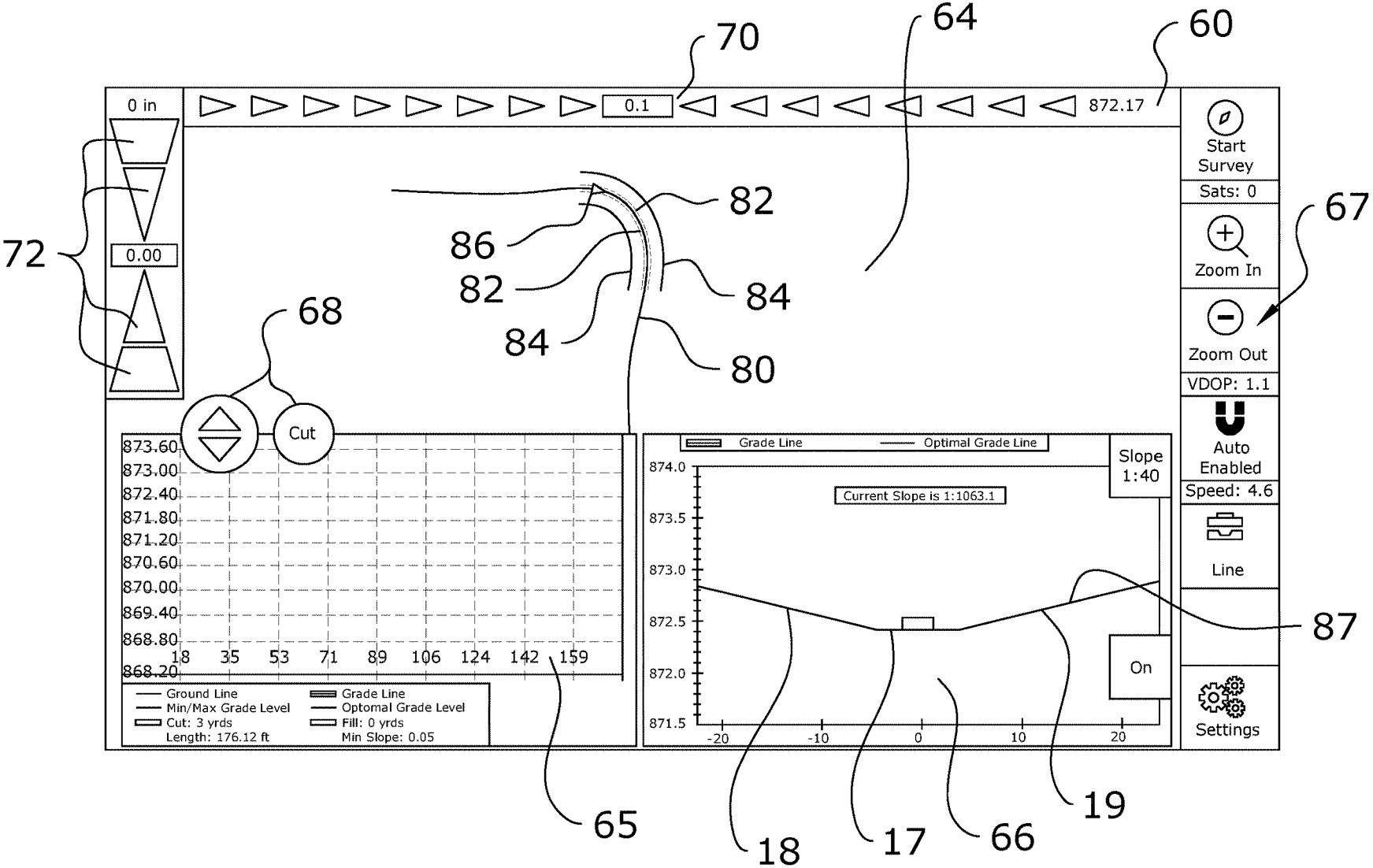
FIG. 10 is an illustrative view of a main display in backsloping mode of an automated backslope cutting system in accordance with an example embodiment.
Figure 11:
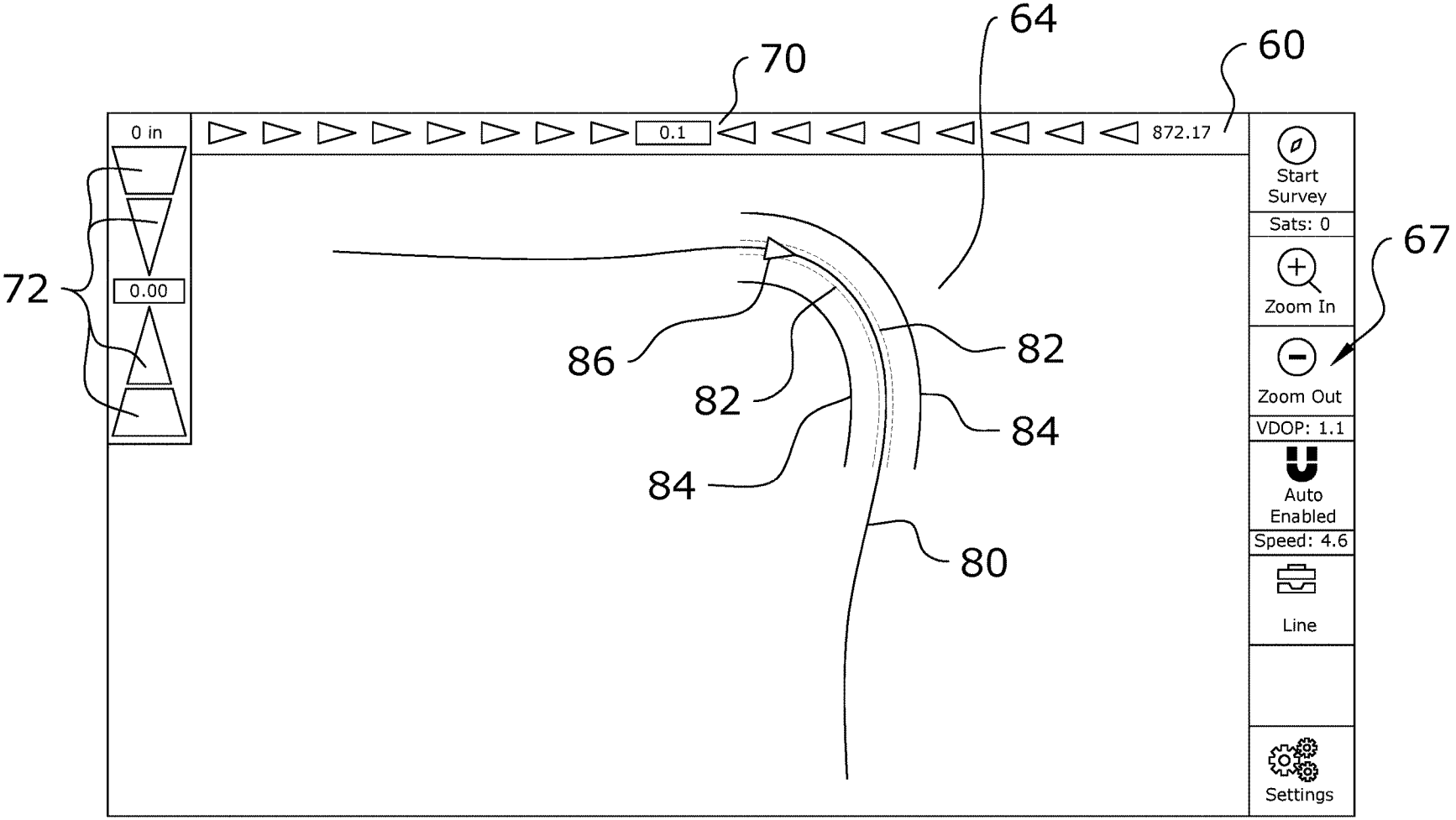
FIG. 11 is an illustrative view of a map display in backsloping mode of an automated backslope cutting system in accordance with an example embodiment.
Figure 12:
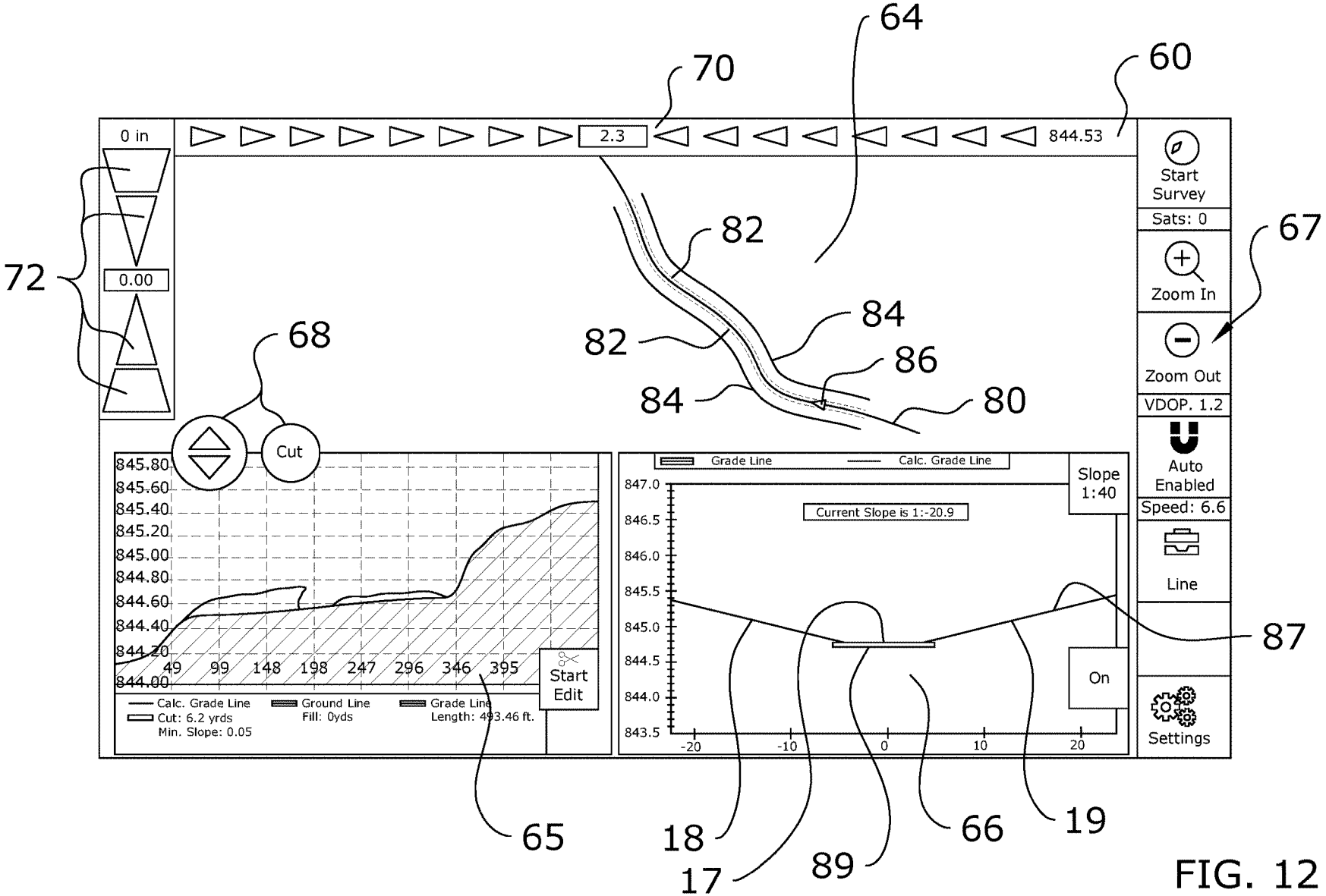
FIG. 12 is an illustrative view of a main display in backsloping mode showing a desired cut of an automated backslope cutting system in accordance with an example embodiment.

FIGS. 8 and 9 illustrate a main display 60 while in surveying mode. As shown, the map view 64 includes a survey line 80 which shows the path of survey which will form the ditch bottom. The current position 86 of the scraper 30 with relation to the survey line 80 is shown on the map view 64 as illustrated in FIGS. 8 and 9. The side view and backslope view windows 65, 66 provide a visual of the side and frontal views of the area being surveyed.

Based on the survey and data entered by the operator, the computing device 30 will calculate a desired cut profile for both the ditch bottom 17 and the backslopes 18, 19. The desired cut profile may include, among other things, elevation data for adjustment of the cutting blade 22 based on positioning data of the scraper 20 to form the ditch 16 including ditch bottom 17 and backslopes 18, 19. More specifically, the desired cut profile may include adjustment data for the scraper 20 to cut the backslopes 18, 19 of the ditch 16 based on the location of the scraper 20 in the surveyed area. Using the desired cut profile, at any given location in the area, the computing device 30 may calculate the proper elevation, angle, or orientation of the scraper 20 to form the ditch 16 in a minimal amount of cuts or passes.

iii. Ditching and Backsloping.

After surveying, the scraper 20 may be utilized to automatically cut the ditch 16, including the ditch bottom 17 and backslopes 18, 19. The scraper 20 generally cuts the ground surface 15 to form the ditch 16, with the computing device 30 automatically adjusting the actuators 52 as the scraper 20 passes over the ground surface 15 based on the desired cut profile. The computing device 30 may direct movement of the scraper 20 across the ground surface 15 of the area to form the ditch bottom 17 and/or backslopes 18, 19.

By using the methods and systems described herein, accurate backslopes 18, 19 can be automatically formed which retain a backslope value ratio while accommodating for the loss of elevation of the ditch 16 as it runs its course. The computing device 30 will automatically direct movement of the scraper 20 to effectuate the cut no matter where the scraper 20 is located in the area. For example, if the computing device 30 detects that the scraper 20 has left the area to be cut, the scraper blade 22 may be raised so that no ground surface 15 is contacted. Upon returning to the area to be cut, the scraper blade 22 will be readjusted to accommodate the cut for that specific area based on the desired cut profile.

In this manner, accurate backslopes 18, 19 may be automatically cut to match the desired cut profile set by the operator and calculated in light of the survey by the computing device 30. Previous systems do not automate backslope 18, 19 formation and thus result in human error.

Figure 24:
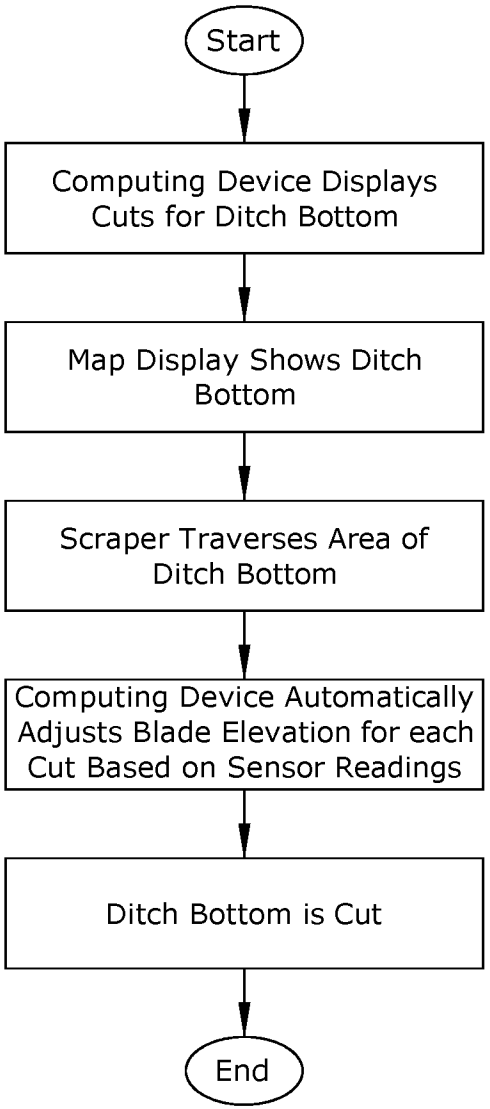
FIG. 24 is a flowchart illustrating automatic cutting of a ditch bottom by an automated backslope cutting system in accordance with an example embodiment.

FIG. 24 illustrates an exemplary method for cutting the ditch bottom 17. The computing device 30 displays cuts for the ditch bottom 17 on the display 60. The scraper 20 traverses the area of the ditch bottom 17 as the computing device 30 automatically adjusts elevation of the cutting blade 22 for each cut based on readings from the sensors 42, 44. The scraper 20 is passed over the ground surface 15 has been cut to the desired grades based on the desired cut profile.

Figure 25:
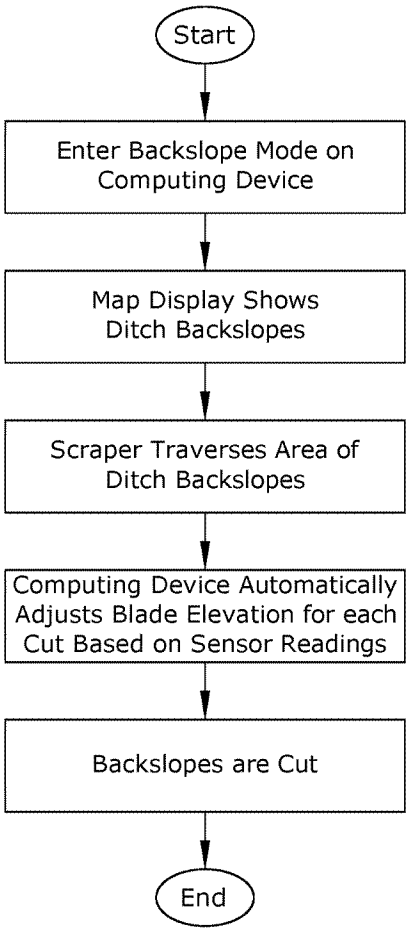
FIG. 25 is a flowchart illustrating automatic cutting of backslopes by an automated backslope cutting system in accordance with an example embodiment.

FIG. 25 illustrates an exemplary method for cutting the backslopes 18, 19. The computing device 30 displays cuts for the backslopes 18, 19 on the display 60. The scraper 20 traverses the area as the computing device 30 automatically adjusts elevation of the cutting blade 22 for each cut based on readings from the sensors 42, 44. The scraper 20 is passed over the area until all of the ground surface 15 has been cut to the desired grades to form backslopes 18, 19 based on the desired cut profile.

The computing device 30 may be adapted to provide multiple cuts or passes for formation of the ditch 16. The scraper 20 may pass over the ground surface 15 a plurality of times to effectuate the multiple cuts of the ground surface 15. The computing device 30 adjusts the elevation of the scraper 20 based on the positional sensor 44 each of the times that the scraper 20 passes over the ground surface 15 to form the ditch 16.

Figure 13:
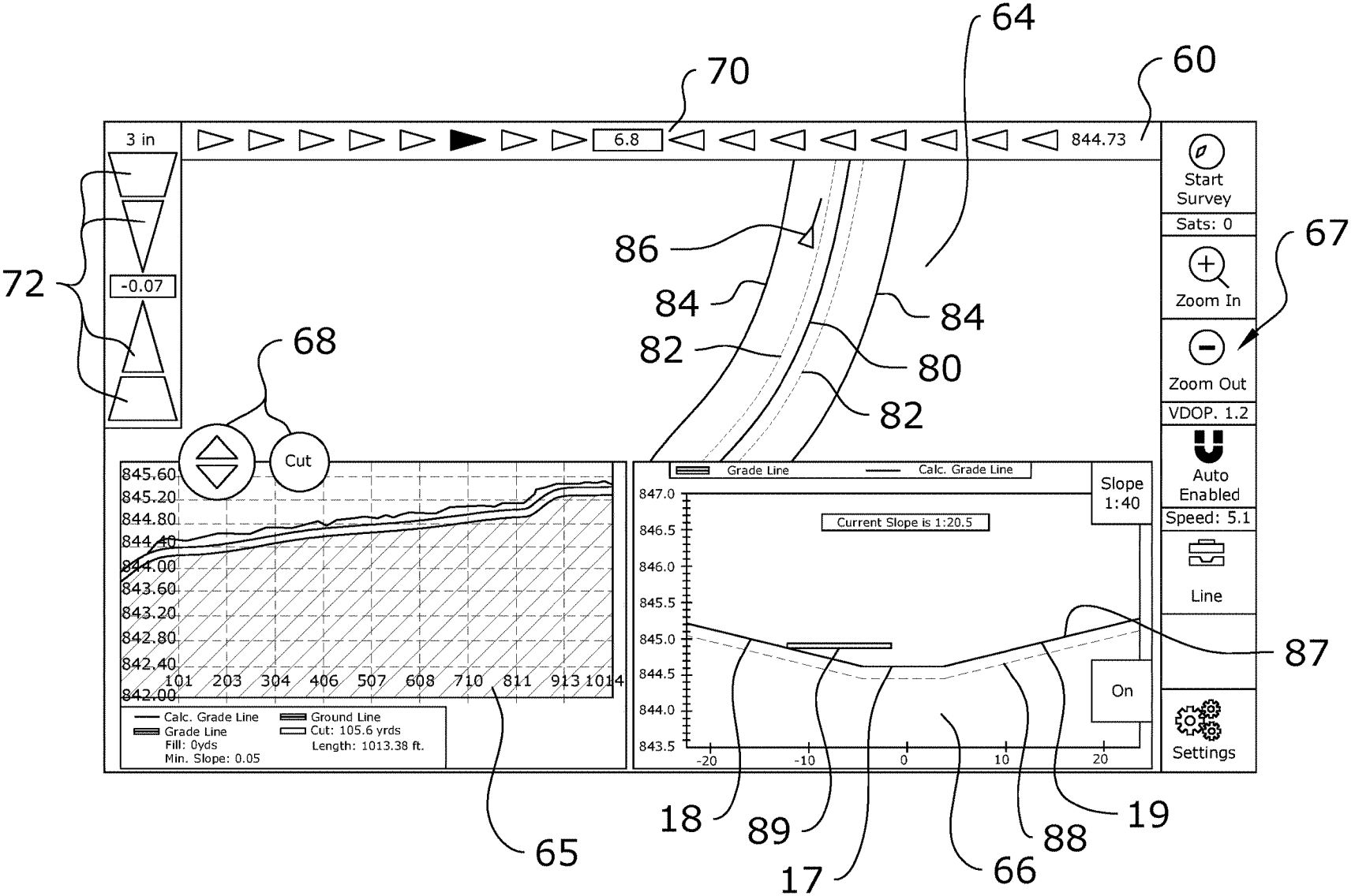
FIG. 13 is an illustrative view of a main display in backsloping mode showing adjustment of the slope of the backslope of an automated backslope cutting system in accordance with an example embodiment.

FIG. 13 shows a main display 60 in backsloping view. In this view, the map window 64 is updated to show, in addition to the survey line 80, ditch bottom lines 82 which define the boundaries of the ditch bottom 17. Also shown are backslope lines 84 which show the borders of the backslopes 18, 19, as well as a current position 86 of the scraper 20. As shown in FIG. 13, the directional status bar 70 also indicates a direction and distance from the scraper 20 to the survey line 80.

FIG. 13 also shows a backslope view window 66 which may be utilized to manually adjust the backslopes 18, 19. This window 66 shows the current backslope 87 as calculated by the computing device 30 based on the operator's inputs and the survey data. A target backslope 88 may be adjusted to raise or lower the backslopes 18, 19 or otherwise alter them. The operator may manually adjust the target backslope 88 to a desired setting, and the computing device 30 will update the desired cut profile to accommodate the target backslope 88. The current blade location 89 is also shown in this view.

Figure 14:
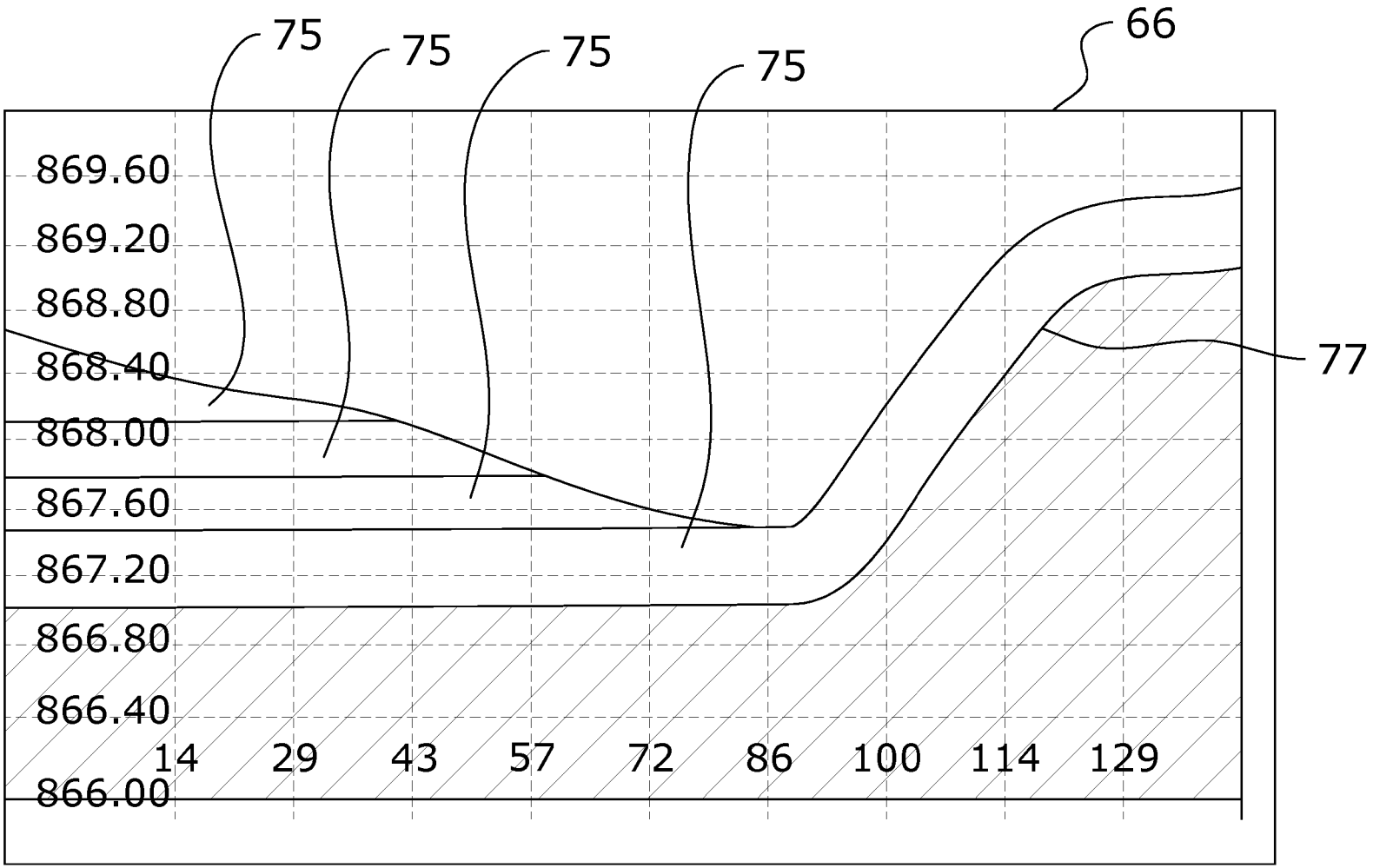
FIG. 14 is an illustrative view of a side view window showing a plurality of target cuts of an automated backslope cutting system in accordance with an example embodiment.
Figure 15:
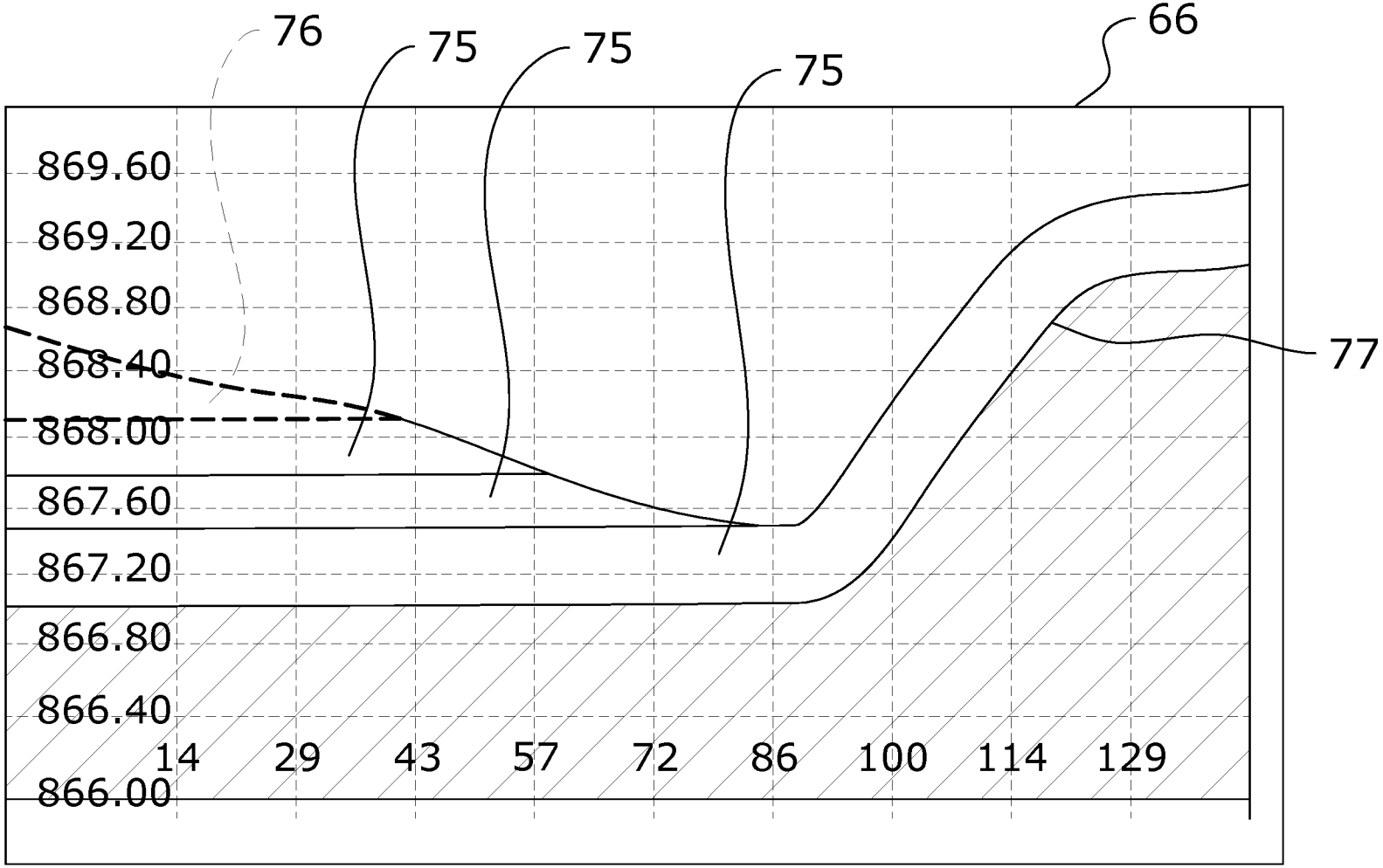
FIG. 15 is an illustrative view of a side view window showing a first completed cut of an automated backslope cutting system in accordance with an example embodiment.
Figure 16:
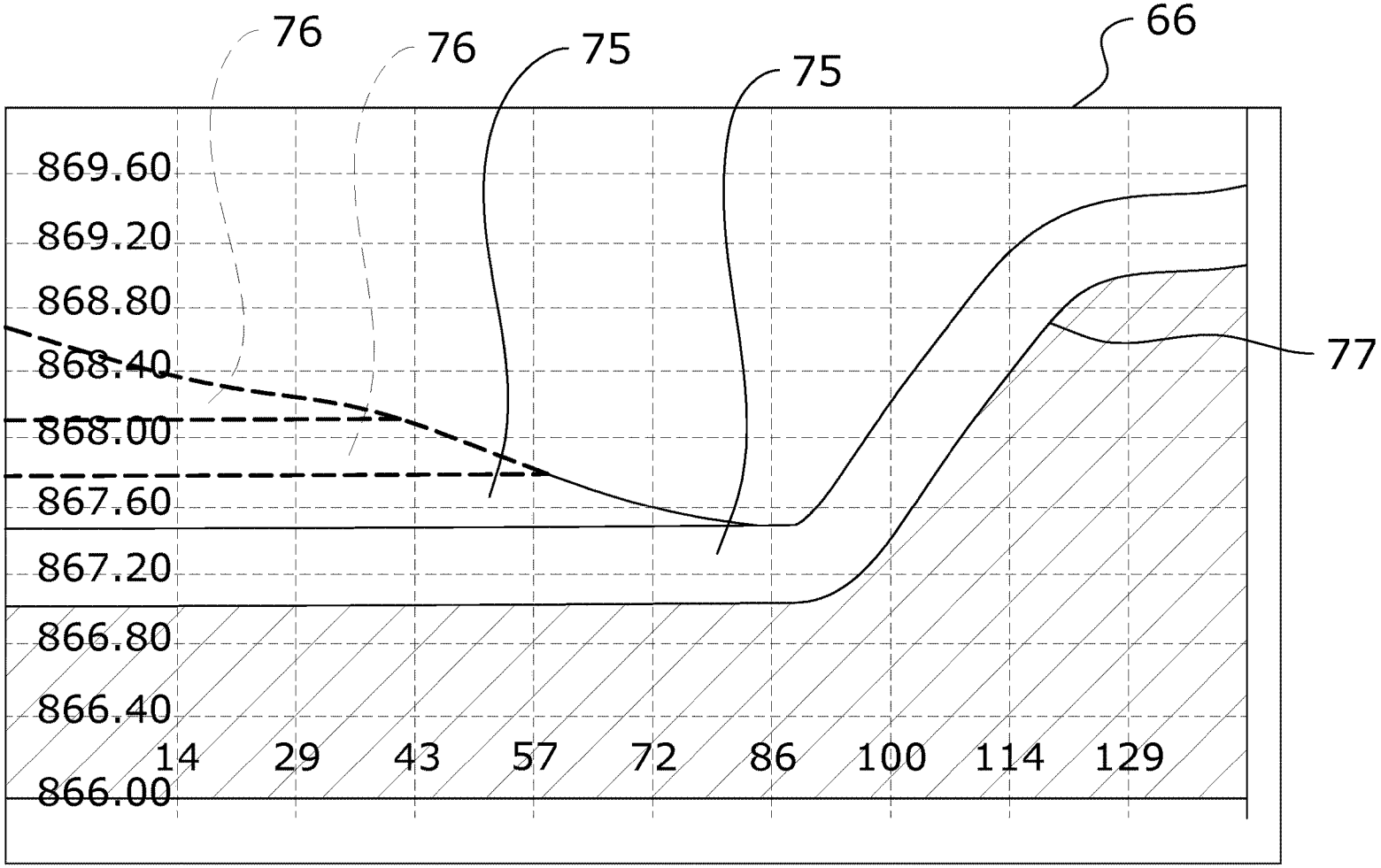
FIG. 16 is an illustrative view of a side view window showing a second completed cut of an automated backslope cutting system in accordance with an example embodiment.
Figure 17:
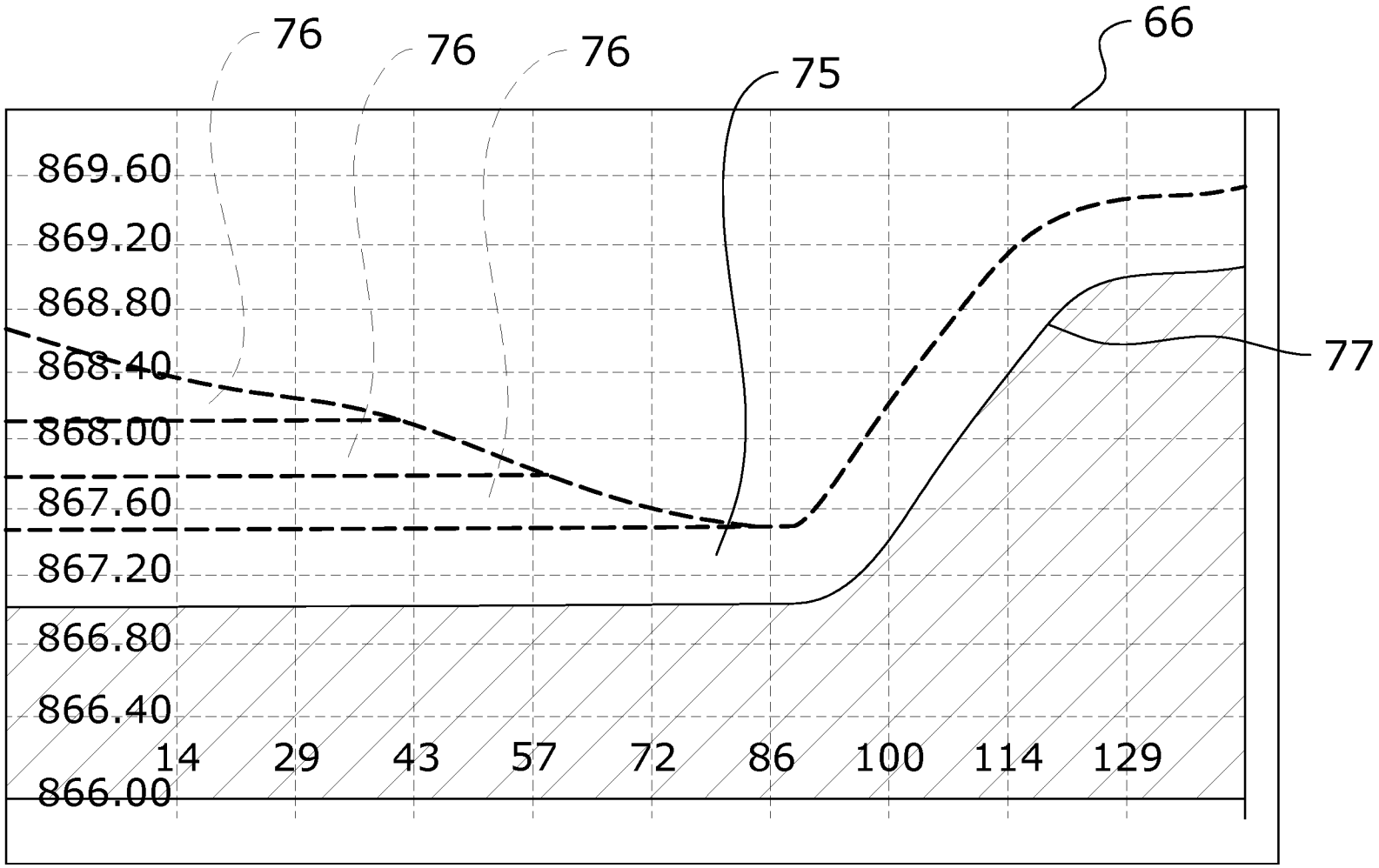
FIG. 17 is an illustrative view of a side view window showing a third completed cut of an automated backslope cutting system in accordance with an example embodiment.

FIG. 14 illustrates a side view window 65 showing multiple target cuts 75. The target cuts 75 have been calculated by the computing device 30 based on manual inputs from the operator and the data from the survey. Each time the scraper 20 passes over one of the target cuts 75, the computing device 30 automatically adjusts the cutting blade 22 to the proper depth for each cut. As each cut is completed, the side view window 65 is updated to show completed cuts 76. This process is repeated until the target grade line 77 is reached as shown in FIGS. 15-17.

Any and all headings are for convenience only and have no limiting effect. Unless otherwise defined, all technical and scientific terms used herein have the same meaning as commonly understood by one of ordinary skill in the art to which this invention belongs. Although specific terms are employed herein, they are used in a generic and descriptive sense only and not for purposes of limitation. All publications, patent applications, patents, and other references mentioned herein are incorporated by reference in their entirety to the extent allowed by applicable law and regulations.

The data structures and code described in this detailed description are typically stored on a computer readable storage medium, which may be any device or medium that can store code and/or data for use by a computer system. This includes, but is not limited to, magnetic and optical storage devices such as disk drives, magnetic tape, CDs (compact discs), DVDs (digital video discs), and computer instruction signals embodied in a transmission medium (with or without a carrier wave upon which the signals are modulated). For example, the transmission medium may include a communications network, such as the Internet.

At least one embodiment of the automated backslope cutting system 10 is described above with reference to block and flow diagrams of systems, methods, apparatuses, and/or computer program products according to example embodiments of the invention. It will be understood that one or more blocks of the block diagrams and flow diagrams, and combinations of blocks in the block diagrams and flow diagrams, respectively, can be implemented by computer-executable program instructions. Likewise, some blocks of the block diagrams and flow diagrams may not necessarily need to be performed in the order presented, or may not necessarily need to be performed at all, according to some embodiments of the invention. These computer-executable program instructions may be loaded onto a general-purpose computer, a special-purpose computer, a processor, or other programmable data processing apparatus to produce a particular machine, such that the instructions that execute on the computer, processor, or other programmable data processing apparatus create means for implementing one or more functions specified in the flow diagram block or blocks. These computer program instructions may also be stored in a computer-readable memory that can direct a computer or other programmable data processing apparatus to function in a particular manner, such that the instructions stored in the computer-readable memory produce an article of manufacture including instruction means that implement one or more functions specified in the flow diagram block or blocks. As an example, embodiments of the invention may provide for a computer program product, comprising a computer usable medium having a computer-readable program code or program instructions embodied therein, said computer-readable program code adapted to be executed to implement one or more functions specified in the flow diagram block or blocks. The computer program instructions may also be loaded onto a computer or other programmable data processing apparatus to cause a series of operational elements or steps to be performed on the computer or other programmable apparatus to produce a computer-implemented process such that the instructions that execute on the computer or other programmable apparatus provide elements or steps for implementing the functions specified in the flow diagram block or blocks. Accordingly, blocks of the block diagrams and flow diagrams support combinations of means for performing the specified functions, combinations of elements or steps for performing the specified functions, and program instruction means for performing the specified functions. It will also be understood that each block of the block diagrams and flow diagrams, and combinations of blocks in the block diagrams and flow diagrams, can be implemented by special-purpose, hardware-based computer systems that perform the specified functions, elements or steps, or combinations of special-purpose hardware and computer instructions.

The present invention may be embodied in other specific forms without departing from the spirit or essential attributes thereof, and it is therefore desired that the present embodiment be considered in all respects as illustrative and not restrictive. Many modifications and other embodiments of the automated backslope cutting system 10 will come to mind to one skilled in the art to which this invention pertains and having the benefit of the teachings presented in the foregoing description and the associated drawings. Therefore, it is to be understood that the invention is not to be limited to the specific embodiments disclosed and that modifications and other embodiments are intended to be included within the scope of the appended claims. Although methods and materials similar to or equivalent to those described herein can be used in the practice or testing of the automated backslope cutting system 10, suitable methods and materials are described above. Thus, the automated backslope cutting system 10 is not intended to be limited to the embodiments shown, but is to be accorded the widest scope consistent with the principles and features disclosed herein.

What is claimed is:

1. A method of automatically cutting a backslope of a ditch with a scraper, comprising:

receiving a calculated cut profile of the backslope in a ground surface by a computing device, wherein the calculated cut profile is based on a survey of the ground surface and wherein the backslope comprises a slope that is transverse to a path of the scraper;

controlling an actuator with the computing device, the actuator being connected to the scraper so as to adjust a cutting blade of the scraper; and automatically adjusting the actuator by the computing device as the scraper traverses the ground surface based on the calculated cut profile such that the cutting blade of the scraper cuts the backslope in the ground surface.

2. The method of claim 1, wherein the computing device is communicatively interconnected with a proximity sensor.

3. The method of claim 2, further comprising the step of detecting rotational movement of the scraper as the scraper passes over the ground surface by the computing device.

4. The method of claim 3, further comprising the step of adjusting the actuator by the computing device to account for any rotational movement of the scraper as the scraper passes over the ground surface.

5. The method of claim 1, wherein the calculated cut profile comprises adjustment data for the scraper to cut the backslope based on a location of the scraper on the ground surface.

6. The method of claim 5, further comprising the step of automatically adjusting the actuator by the computing device based on the adjustment data to cut the backslope.

7. The method of claim 1, further comprising the step of directing movement of the scraper across the ground surface by the computing device to cut the backslope.

8. The method of claim 1, wherein the computing device is communicatively interconnected with a positional sensor.

9. The method of claim 8, further comprising the step of adjusting the elevation of the blade of the scraper by the computing device based on positional data from the positional sensor.

10. The method of claim 9, wherein the positional sensor comprises a GPS receiver.

11. The method of claim 1, wherein the survey of the ground surface is performed by the computing device.

12. An automated ditch cutting system, comprising:

a scraper comprising a blade having a cutting edge for cutting a ground surface to cut a backslope of a ditch, wherein the backslope comprises a slope that is transverse to a path of the scraper;

an actuator for adjusting the blade of the scraper;

a computing device adapted to control the actuator to adjust the blade of the scraper; and a positional sensor on the scraper, wherein the positional sensor is communicatively interconnected with the computing device such that the positional receiver communicates positional data of the scraper to the computing device;

wherein the computing device is adapted to receive a calculated cut profile for the backslope based on a survey of the ground surface, wherein the computing device is adapted to automatically adjust the blade of the scraper based on positional data from the positional receiver with respect to the ground surface to cut the backslope based on the calculated cut profile.

13. The automated ditch cutting system of claim 12, wherein the calculated cut profile comprises elevation data for adjustment of the scraper blade based on positioning data of the scraper to cut the backslope as the scraper traverses the ground surface.

14. The automated ditch cutting system of claim 12, wherein the positional sensor comprises a GPS receiver.

15. The automated ditch cutting system of claim 12, further comprising a proximity sensor for detecting rotational movement of the scraper, wherein the proximity sensor is communicatively interconnected with the computing device.

16. The automated ditch cutting system of claim 15, wherein the computing device is adapted to adjust the actuator to account for any rotational movement of the scraper as the scraper passes over the ground surface.

17. The automated ditch cutting system of claim 12, further comprising a hydraulic controller for extending or retracting the actuator, wherein the hydraulic controller is communicatively interconnected with the computing device.

18. The automated ditch cutting system of claim 17, further comprising a digital-to-analog-converter communicatively interconnected with both the computing device and the hydraulic controller, wherein the digital-to-analog converter is adapted to transmit a signal to the hydraulic controller to adjust the blade of the scraper according to the calculated cut profile.

19. A method of automatically cutting a ditch, comprising:

surveying a ground surface in an area to be cut into a ditch by a computing device, wherein the computing device is communicatively interconnected with a positional sensor;

determining a calculated cut profile to cut a backslope of the ditch based on the surveying of the ground surface by the computing device, wherein the backslope comprises a slope that is transverse to a path of the scraper;

controlling an actuator with the computing device, the actuator being connected to a scraper so as to adjust a cutting blade of the scraper; and automatically adjusting the actuator as the scraper cuts the ground surface based on the calculated cut profile by the computing device; and adjusting the elevation of the cutting blade of the scraper by the computing device based on positional data from the positional sensor.

20. The method of claim 19, further comprising a proximity sensor for detecting rotational movement of the scraper, wherein the proximity sensor is communicatively interconnected with the computing device, and further comprising the step of adjusting the actuator by the computing device to account for rotational movement of the scraper as the scraper passes over the ground surface.

* * * * *